US006129013A

United States Patent [19]

Takasawa et al.

[11] Patent Number: 6,129,013

[45] Date of Patent: Oct. 10, 2000

[54] STENCIL PRINTER

[75] Inventors: Hironobu Takasawa, Watari-gun; Mituru Takahashi, Shiroishi; Naoki Okazaki, Shibata-gun, all of Japan

[73] Assignee: Tohoku Ricoh Co., Ltd., Shibata-gun, Japan

[21] Appl. No.: 09/150,167

[22] Filed: Sep. 9, 1998

[30] Foreign Application Priority Data

| | | | |
|---|---|---|---|
| Sep. 9, 1997 | [JP] | Japan | 9-243952 |
| Jun. 11, 1998 | [JP] | Japan | 10-163713 |

[51] Int. Cl.[7] ..... B41F 15/00

[52] U.S. Cl. ..... 101/114; 101/116; 101/232; 101/127

[58] Field of Search ..... 101/114, 116, 101/118, 123, 232, 129, 115, 117, 127, 127.1; 271/193

[56] References Cited

U.S. PATENT DOCUMENTS

| | | | |
|---|---|---|---|
| 3,779,160 | 12/1973 | Black et al. | 226/62 |
| 5,517,913 | 5/1996 | Oshio et al. | 101/119 |
| 5,689,297 | 11/1997 | Yokoyama et al. | 347/188 |
| 5,782,178 | 7/1998 | Otomo | 101/119 |
| 5,937,750 | 8/1999 | Takeda | 101/116 |
| 5,953,988 | 9/1999 | Vinck | 101/129 |

FOREIGN PATENT DOCUMENTS

| | | |
|---|---|---|
| 60-148864 | 8/1985 | Japan . |
| 60-148866 | 8/1985 | Japan . |
| 1-290489 | 11/1989 | Japan . |
| 4-133083 | 5/1992 | Japan . |
| 4-322277 | 11/1992 | Japan . |
| 8-25778 | 1/1996 | Japan . |
| 9-24604 | 1/1997 | Japan . |
| 9-104158 | 4/1997 | Japan . |
| 11-105400 | 4/1999 | Japan . |

*Primary Examiner*—John S. Hilten
*Assistant Examiner*—Charles H. Nolan, Jr.
*Attorney, Agent, or Firm*—Oblon, Spivak, McClelland, Maier & Neustadt, P.C.

[57] ABSTRACT

A stencil printer of the present invention includes at least one ink drum for wrapping a master around its outer periphery. An ink feed device feeds ink to the master wrapped around the ink drum. A pressing member is movable into and out of contact with the ink drum at a position where it faces the ink feed device. An image is printed on a paper fed from a paper feed section at a print section where the ink drum and pressing member face each other. A belt conveyor includes a belt extending between the paper feed section located upstream of the print section in the direction of paper conveyance and a paper discharge section located downstream of the print section in the same direction through the print section. The belt conveys the paper fed from the paper feed section while causing it to electrostatically adhere thereto. The paper is sufficiently electrostatically adhered to the belt before it reaches the print section, so that air suction, an air knife, a separator or the like is not necessary. The paper is smoothly conveyed to the print section without any noise and surely separated from the ink drum. Because the pressing member brings the belt into and out of contact with the ink drum, an exclusive mechanism for so moving the belt is not necessary.

23 Claims, 17 Drawing Sheets

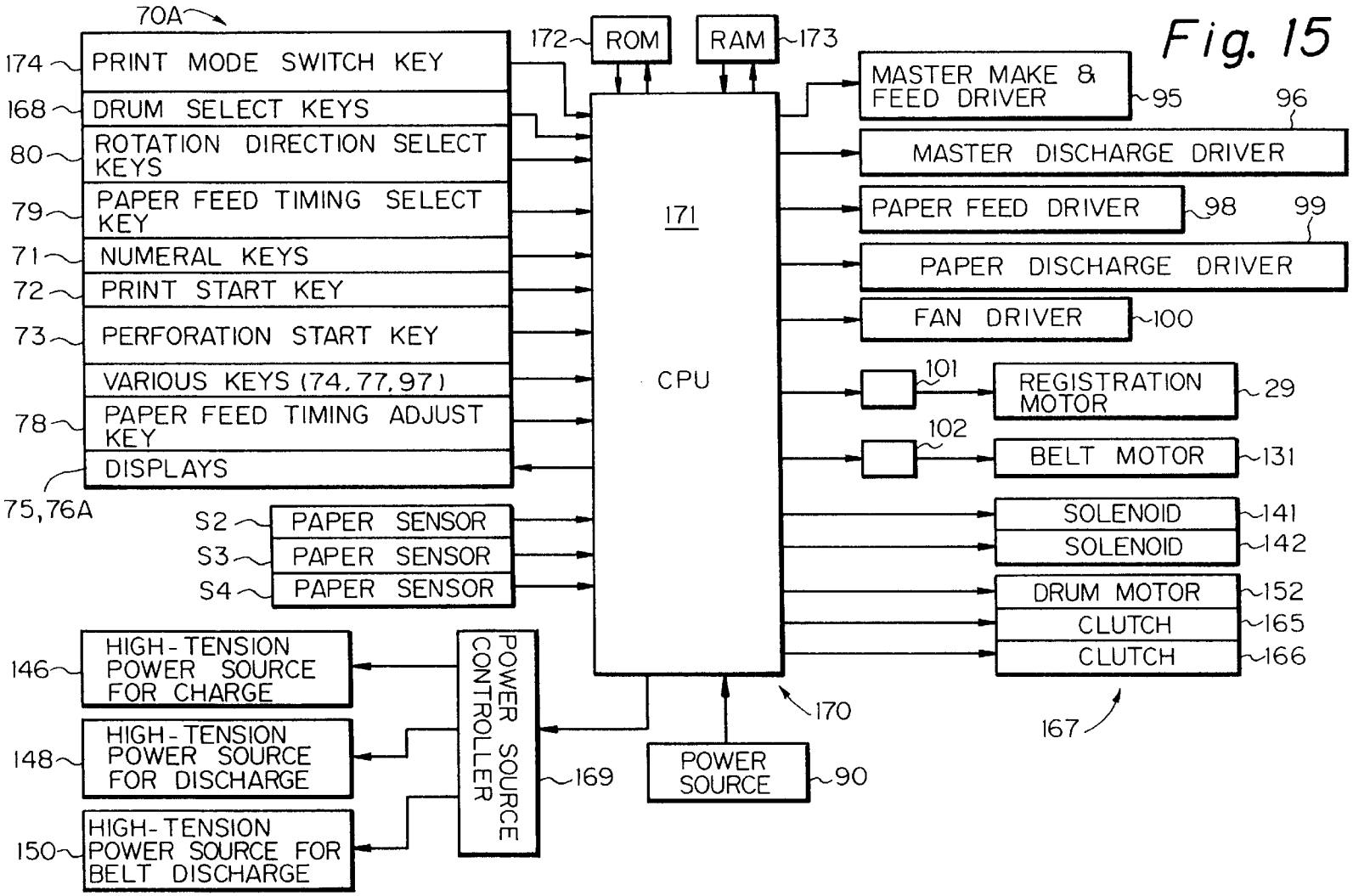
Fig. 15
MASTER MAKE & FEED DRIVER
95
MASTER DISCHARGE DRIVER
96
PAPER FEED DRIVER
98
PAPER DISCHARGE DRIVER
99
FAN DRIVER
100
REGISTRATION MOTOR
29
BELT MOTOR
131
SOLENOID
141
SOLENOID
142
DRUM MOTOR
152
CLUTCH
165
CLUTCH
166
167
101
102
RAM
173
ROM
172
171
CPU
170
POWER SOURCE
90
169
POWER SOURCE CONTROLLER
70A
PRINT MODE SWITCH KEY
DRUM SELECT KEYS
ROTATION DIRECTION SELECT KEYS
PAPER FEED TIMING SELECT KEY
NUMERAL KEYS
PRINT START KEY
PERFORATION START KEY
VARIOUS KEYS (74, 77, 97)
PAPER FEED TIMING ADJUST KEY
DISPLAYS
PAPER SENSOR
PAPER SENSOR
PAPER SENSOR
S2
S3
S4
HIGH-TENSION POWER SOURCE FOR CHARGE
HIGH-TENSION POWER SOURCE FOR DISCHARGE
HIGH-TENSION POWER SOURCE FOR BELT DISCHARGE
174
168
80
79
71
72
73
78
75, 76A
146
148
150

STENCIL PRINTER

BACKGROUND OF THE INVENTION

The present invention relates to a printer and, more particularly to, a stencil printer for printing an image represented by perforations formed in a master on a paper or similar recording medium.

It is a common practice with a stencil printer to wrap a master around an ink drum and feed ink to the master via an ink feeding means. A press roller, press drum or similar pressing means is pressed against the ink drum at a position where the pressing means faces the ink feeding means, so that an image is printed on a paper at a print section where the ink drum and pressing means face each other. The paper with the image, i.e., a printing is conveyed to a paper discharge section by a belt while being retained on the belt by a suction fan. Separating means is arranged above the belt and includes a peeler for peeling the paper adhered to the ink drum due to the viscosity of the ink, and an air knife for sending a stream of air from the edge of the peeler in order to promote the separation of the paper from the drum.

However, the above stencil printer has the following problems left unsolved. When the paper carries a solid image at its leading edge portion or when the image ratio at the leading edge of the paper is great, adhesion between the paper and the ink drum increases and prevents the paper from being adequately peeled off from the drum. As a result, the paper tends to roll up and has its image surface smeared by the peeler in the form of marks. Further, the air knife and suction fan associated with the peeler and belt, respectively, produce noise due to the stream of air and suction.

In light of the above, Japanese Patent Laid-Open Publication No. 9-24604 teaches that a charged belt is positioned downstream of a print section where pressing means and an ink drum face each other in the direction of paper conveyance. The belt causes a paper to electrostatically adhere thereto and thereby separates it from the ink drum. The above document also teaches that a belt is passed over a roller facing a print drum and a roller located downstream of the drum in the direction of paper conveyance. In this configuration, the belt is angularly movable about the downstream roller into and out of contact with the ink drum; a position where the belt and drum face each other define a print section.

A problem with the above angularly movable belt scheme is that a space broad enough for the belt to be bodily angularly moved about the downstream roller relative to the ink drum is necessary below the ink drum and increases the overall size of the printer. Another problem is that an exclusive mechanism for moving the entire belt into and out of contact with the ink drum is required, sophisticating the construction of the printer. Particularly, when the belt is arranged downstream of the print section defined by the pressing means and ink drum, the mechanism for so moving the belt must be provided independently of a mechanism for moving the pressing means. A further problem is that because the belt is passed over the roller facing the ink drum and the downstream roller, the conveying surface of the belt cannot cover the portion upstream of the print section. As a result, the conveyance of the paper to the print section and the entry of the same into the print section are irregular, rendering the position of an image on the paper unstable.

On the other hand, Japanese Patent Laid-Open Publication No. 1-290489 discloses a stencil printer with a multicolor printing capability and including a plurality of ink drums arranged side by side in the direction of paper conveyance. The ink drums each is supplied with ink of particular color. Particular pressing means is pressed against each ink drum with the intermediary of a belt, causing the drum and belt to nip a paper for printing an image thereon. After an image has been printed on the paper by the upstream ink drum, the paper is conveyed toward the downstream drum while being electrostatically adhered to the belt.

The multicolor stencil printer taught in the above document has some drawbacks, as follows. Assume that a solid image is printed on the leading edge portion of a paper, that the image ratio of the leading edge portion of the paper is great, or that the viscosity of ink is caused to vary by the varying ambient temperature. Then, the paper cannot be adequately peeled off from the upstream ink drum and rolls up. That is, the belt with the suction fan cannot sufficiently suck the paper thereonto, depending on the condition of the image and/or the viscosity of the ink. As a result, the timing for the paper to reach the downstream ink drum is delayed. The delay renders the timing for ink to be transferred from the downstream ink drum to the paper irregular, resulting in the dislocation of an image or the overlapping of image components of different colors. Although the sucking force of the suction fan may be intensified in order to prevent the paper from rolling up, such an approach would aggravate noise ascribable to suction. Thus, there is an increasing demand for a new mechanism capable of conveying a paper while surely retaining it.

Technologies relating to the present invention are also disclosed in, e.g., Japanese Patent Laid-Open Publication Nos. 60-148864, 60-148866, 4-133083, 4-322277, and 9-104158.

SUMMARY OF THE INVENTION

It is therefore an object of the present invention to provide a stencil printer capable of conveying a paper stably with a noise-free, miniature configuration while preventing the paper from rolling up or from being smeared by the marks of a peeler.

It is another object of the present invention to provide a stencil printer having a multicolor printing capability and allowing a minimum of image dislocation and a minimum of image overlapping to occur.

A stencil printer of the present invention includes at least one ink drum for wrapping a master around its outer periphery. An ink feed device feeds ink to the master wrapped around the ink drum. A pressing member is movable into and out of contact with the ink drum at a position where it faces the ink feed device. An image is printed on a paper fed from a paper feed section at a print section where the ink drum and pressing member face each other. A belt conveyor includes a belt extending between the paper feed section located upstream of the print section in the direction of paper conveyance and a paper discharge section located downstream of the print section in the same direction via the print section. The belt conveys the paper fed from the paper feed section while causing it to electrostatically adhere thereto.

BRIEF DESCRIPTION OF THE DRAWINGS

The above and other objects, features and advantages of the present invention will become apparent from the following detailed description taken with the accompanying drawings in which:

FIG. 15 is a block diagram schematically showing a control system included in the third embodiment;

DESCRIPTION OF THE PREFERRED EMBODIMENTS

Figure 1:
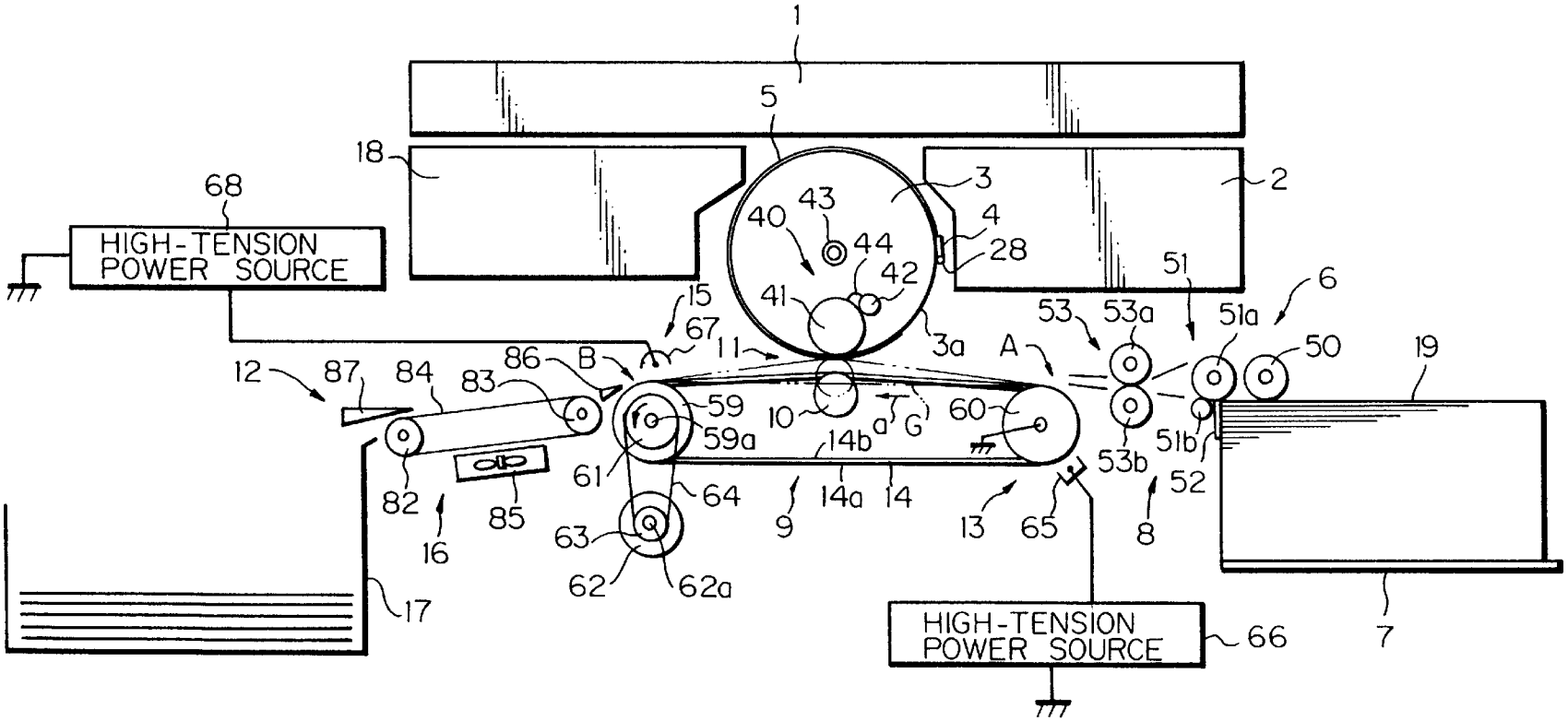
FIG. 1 shows a first embodiment of the stencil printer in accordance with the present invention.

Basically, a stencil printer of the present invention includes an ink drum for wrapping a master therearound. Ink feeding means for feeding ink to the master is arranged in the ink drum. Pressing means is movable into and out of contact with the ink drum at a position where it faces the ink feeding means. An image is printed on a paper at a print section where the ink drum and pressing means face each other. A sheet feed section is located upstream of the print section in the direction of paper conveyance while a paper discharge section is located downstream of the print section in the above direction. A belt conveyor is arranged between the paper feed section and the paper discharge section while extending via the print section in order to convey the paper to the print section while causing it to electrostatically adhere thereto.

The belt arranged in the above condition forms a paper transport path extending from the paper feed section to the paper discharge section via the print section. This allows the paper to sufficiently electrostatically adhere to the belt before reaching the print section and thereby insures stable conveyance of the paper and smooth entry of the paper into the print section. Further, the area over which the paper and belt contact each other sequentially increases during conveyance of the paper toward the paper discharge section, intensifying electrostatic adhesion between the paper and the belt. Consequently, the paper can be surely separated from the ink drum at the print section.

The above belt may be formed of either one of an insulator and a substance having a medium resistance. The belt formed of insulator has a volume resistivity of $10^{13}$ Ω or above and a thickness of 10 μm to 500 μm. As for the insulator, use may be made of polyimide, polyethylene terephthalate, polyester, polyacetal, polypropylene, vinyl chloride, styrol, urethane, polyethylene, polycarbonate, polytetrafluoroethylene or similar resin with or without aluminum, copper, nickel, silver or similar conductive metal deposited thereon by vacuum deposition or adhered thereto by adhesive, or a suitable synthetic polymer alloy. When the belt formed of insulator is applied with a voltage, it is dielectrically polarized to positive polarity or negative polarity. As a result, the paper and belt each is charged to one of positive and negative polarities and adhered to the other. Alternatively, the polarity of the voltage may be switched such that a negative charge and a positive charge are injected into the belt alternately, forming an electrostatic pattern with the positive charge and negative charge alternating with each other on the belt. When the paper or insulative body approaches such an electrostatic pattern, i.e., an unequal electric field formed thereby, the energy of the field will be reduced, and the resulting adhering force will cause the paper to adhere to the belt.

The belt formed of a substance having a medium resistance has a volume resistivity of $10^{7}$ Ωcm to $10^{12}$ Ωcm and a thickness of 10 μm to 500 μm. For sch a substate, use may be made of chloroprene rubber, ethylene propylene rubber (EPDM) or similar elastic substance coated with, e.g., fluorine (vinylidene polyfluoride). Why the elastic body is coated with fluorine (vinylidene polyfluoride) is as follows. Fluorine reduces the coefficient of friction ($\mu$) and therefore the load torque when belt cleaning means is caused to contact the belt, while preventing the belt cleaning means from being turned over. Further, because fluorine provides the surface of the belt with a higher resistance than the elastic substance, the resistance of the belt and that of the paper are reduced in a hot and humid environment. This causes the charge on the belt to be transferred to the paper and thereby allows a minimum of adhesion to occur between the master wrapped around the drum and the paper where resistance varies little. Consequently, the paper is prevented from wrapping around the ink drum or from being defectively separated from the drum.

The belt should preferably be implemented by a seamless belt. A belt with a seam is apt to leave its mark in an image printed on the paper.

The stencil printer of the present invention is operable with a single ink drum or a plurality of ink drums, as desired. When a plurality of ink drums are arranged side by side in the direction of paper conveyance, the printer turns out a multicolor printer. For example, when the printer is provided with four ink drums and four pressing means respectively to associated with the ink drums, it turns out a so-called tetracolor full-color printer if cyan ink, magenta ink, yellow ink and black ink are respectively fed to the four drums. Further, two pairs of ink drums and pressing means may be added to implement a hexacolor full-color printer; two additional colors may be, e.g., gold and silver. Of course, the ink drums may share the same color of ink, in which case one ink drum will be operated with the same or fixed master while the other ink drum will be operated with a master representative of a portion different from the fixed master.

When the printer includes a plurality of ink drums, an arrangement may be made such that the operator of the printer is capable of selecting one of them on drum selecting means. For example, if two ink drums are available and if the operator selects upstream one of them, then the rotation of the upstream drum and the movement of the pressing means assigned to the upstream drum will be controlled. Because the other ink drum and pressing means do not have to be operated, the viscosity of the ink in the ink drum is prevented from being reduced. In addition, the ink drum not to be used does not have to be removed from the printer, so that the printer is convenient to use.

The charging means for charging the belt may be implemented by either one of a corotron charger, scorotron charger or similar non-contact type charger including a discharge member in the form of a wire, and a roller, conductive brush or similar contact type charge member. The non-contact type charging means is somewhat low in discharge efficiency because a discharge current flows to a casing supporting the discharge wire. However, this type of charging means is advantageous in that the current density is high enough to realize stable charging. As for the discharge efficiency, the contact type charging means injecting a charge in contact with the belt is desirable. Another advantage of the contact type charging means is that it produces a minimum of ozone in air which is desirable from the office environment standpoint.

A constant power source, constant current source or similar high-tension power source is used to feed the charge to the discharge member. A constant voltage power source is desirable in that the discharge current is constant and facilitates the design of the withstanding voltage of the power source and that of the discharge member. A constant current power source stabilizes the surface potential of the belt because its discharge current changes little even when the atmospheric pressure, temperature or similar environmental condition varies, compared to the constant voltage power source. When the non-contact type charging means is used, the charge of the belt is apt to become irregular despite the constant current or constant voltage of the power source. In such a case, the charge condition (surface potential) of the belt should preferably be sensed and fed back to the high-tension power source. In any case, the above charging means should preferably be located closer to the paper feed section than the print section, so that the paper fed from the paper feed section can be sufficiently electrostatically adhered to the belt before reaching the print section.

To separate the paper with an image from the belt, it is preferable that discharging means be positioned closer to the paper discharge section than the print section for dissipating the charge remaining on the paper and belt. While the discharging means may also be implemented by either one of the previously stated non-contact type discharging means and contact type discharging means, the non-contact type discharging means is advantageous in that it does not contact an image printed on the paper. The discharging means discharges a charge for neutralizing the charge deposited on the belt by the charging means.

The printer is capable of executing a master making step to a master discharging step alone if provided with document reading means for reading a document laid on a glass platen, master making and feeding means for perforating a stencil paid out from a roll in accordance with an image signal output from the document reading means while sequentially feeding the perforated part of the stencil toward the ink drum, and master discharging means for peeling off a used master from the ink drum and storing it in a master discharge section.

The paper being conveyed by the belt while being electrostatically adhered to the belt sometimes jam the transport path. In light of this, the belt conveyor should preferably be constructed and controlled such that the belt is movable in opposite directions to convey the paper to the paper feed section or to the paper discharge section, as needed. Particularly, when the printer includes a plurality of ink drums, the paper transport path is longer than when the printer includes a single ink drum. In this respect, the reversible movement of the belt allows the jamming paper to be moved to the paper feed section or the paper discharge section closer to the jam position, so that the paper can be rapidly removed.

To cause the paper to contact the belt more rapidly and more closely, a paper pressing member should preferably be held in contact with the portion of the belt between the paper feed section and the print section. The paper pressing member may advantageously be implemented by a roller member contacting the outer surface of the belt or by roller members nipping the belt at both sides of the belt.

Assume that the above paper pressing member is connected to the high-tension power source so as to play the role of a discharge member included in the charging means. Then, the belt can be charged at a position closer to the paper feed section than the print section. This, coupled with the fact that the paper fed from the paper feed section is pressed against the belt, successfully intensifies electrostatic adhesion between the paper and the belt. Further, if the paper feed timing and the timing for the charging means to charge the belt are coincident, then the discharge member can charge both the paper and the belt while pressing the paper against the belt to thereby reduce the charging time. In addition, the charging means and paper pressing member may be implemented as a single member so as to reduce the number of parts and space requirement of the printer.

The paper pressing member in the form of a roller member functions as a roller-like discharge member or discharge roller. This kind of paper pressing member is capable of injecting a charge in contact with the belt even when the peripheral speed of the belt is increased. This is also true when the discharge member used as the charging means is implemented as a charge roller.

The charge roller may have any one of a low resistance, a medium resistance, and a high resistance. The charge roller of low resistance has a volume resistivity of $10^6$ Ωcm or below and may be formed of natural rubber, nitril, EPDM, polyurethane or silicone rubber with aluminum, iron, copper, stainless steel or similar metal and carbon black or similar conductive filler dispersed therein, or a foamed body of the same. The charge roller of low resistance should preferably have a rubber hardness between 20 degrees and 70 degrees as prescribed by JIS (Japanese Industrial Standards)-A. The charge roller of low resistance is desirable for low voltage applications because it has a high charging efficiency for a given printing speed.

The charge roller of medium resistance has a volume resistivity of $10^7$ Ωcm and $10^{12}$ Ωcm and may be formed of natural rubber, nitril, EPDM, polyurethane or silicone rubber with epichlorohydrin rubber, carbon black or similar conductive filler dispersed therein, or a foamed body of the same. The charge roller of medium resistance should preferably have a rubber hardness between 20 degrees and 70 degrees as prescribed by JIS-A. Such a charge roller of medium resistance is constituted by a polar rubber elastic layer in which rubber itself has a medium resistance, serving as an electrically uniform, medium resistance body. The charge roller can therefore uniformly charge the belt when applied only with DC and is suitable for DC applications because of its high withstanding voltage.

The charge roller of high resistance has a volume resistivity of $10^{13}$ Ωcm or above and may be formed of, e.g., fluorine-contained resin. This kind of charge roller is characterized in that it has a high capacity and is made up of a carbon dispersed, conductive rubber elastic layer and a high resistance layer. The high resistance layer constitutes a surface layer and consists of polar rubber (e.g. epichlorohydrin rubber, nitril rubber, urethane rubber, acryl rubber or chloroprene rubber) and nonadhesive resin (e.g. fluoric resin or silicone resin). The resin content (high resistance) of the surface layer sequentially increases toward the surface while the rubber content of the same sequentially increases toward the elastic layer. The ratio between the electric resistance of the elastic layer and that of the surface layer is less than $10^3$ Ωcm. This kind of charge roller is feasible for DC+AC voltage applications because it allows an AC current to smoothly flow therethrough.

For more efficient charging of the belt, an electrode may be located to face the discharge electrode of the charging member with the intermediary of the belt. While this electrode may be provided independently of the other members, it should preferably be implemented, from the space and cost standpoint, by a roller member over which the belt is passed. When the roller member is used as the above facing electrode, a contact type or a non-contact type discharge member may advantageously be located to face the roller member. As for the roller member playing the role of the facing electrode, a roller member positioned at the paper feed section side, more preferably a roller member adjoining the path along which the paper fed from the paper feed section is conveyed, should be used.

The roller member to serve as the facing electrode needs only a volume resistivity of less than $10^6$ Ωcm and may advantageously be formed of natural rubber, nitril rubber, EPDM, polyurethane or silicone rubber with aluminum, iron, copper, stainless steel or similar metal and carbon black or similar conductive filler dispersed therein, or a foamed body thereof. The roller member has a rubber hardness preferably ranging from 20 degrees to 70 degrees as prescribed by JIS-A.

Because the size and thickness of the paper to be conveyed by the belt is not constant, the charge deposited on the belt and paper is apt to be irregular when the output of the discharging means is constant. To solve this problem, belt discharging means may advantageously be used to again discharge the belt after the separation of the sheet. If any charge is left on the belt having been discharged by the discharging means, the amount of charge injection to be effected by the charging means later will be short and will render electrostatic adhesion between the paper and the belt insufficient. In light of this, a DC high-tension power source opposite in polarity to the power source assigned to the charging means should preferably be assigned to the belt discharging means. To allow the belt discharging means to discharge the belt more positively, a discharge member included in the belt discharging means may be held in contact with the belt, or an electrode may be located to face the discharge member. It is preferable that the belt discharging means be located downstream of the discharging means in the direction of paper conveyance, i.e., between the discharging means located upstream of the charging means and the charging means.

The belt may be passed over a pair of roller members, i.e., a drive roller and a driven roller. Alternatively, the belt may be passed over the above two rollers and two tension rollers diagonally facing each other. In any case, the belt is arranged between the paper feed section and the paper discharge section while extending through the print section.

When the pressing means is brought into contact with the belt being moved, it is likely that the peripheral speed of the belt varies due to the resulting contact resistance. It is therefore preferable that the belt and pressing means be constantly held in contact with each other without regard to the position of the pressing means.

The pressing means may be implemented as a press drum or a press roller taught in, e.g, Japanese Patent Laid-Open Publication No. 9-104158 mentioned earlier. For the press roller, use may be made of natural rubber, chloroprene rubber, nitril rubber, EPDM, butadien rubber, styrene butadien rubber or silicone rubber. The press roller has a rubber hardness preferably ranging from 20 degrees to 70 degrees as prescribed by JIS-A. Such rubber may be implemented as a solid body or a foam rubber, as needed.

The stencil to be perforated by the master making and feeding means has a laminate structure made up of a porous support and a thermoplastic polyester resin film adhered to the support. Alternatively, the stencil may be made up of a porous support in the form of a thin porous sheet of kozo, mitsumata, Manila hemp, flax or similar natural fibers or an unwoven cloth of rayon, vinylon or polyester, and a master film of polyester resin or similar thermoplastic resin adhered to the support. If desired, the stencil may be implemented substantially only by a thin polyester film or similar thermoplastic resin film with or without an antistatic layer or a layer for preventing the film from sticking to a thermal head.

The ink drum is made up of a thin porous plate forming an inner periphery and a porous elastic layer covering the porous plate. The elastic layer holds and scatters ink and releases the ink when pressed. The thin porous plate may be implemented by a thin stainless steel plate or a thin plate produced by nickel electrofoaming and provided with a cylindrical configuration. A number of pores are formed in the porous plate for passing ink therethrough. For the ink, use may be made of emulsion ink or similar ink customarily used with a mimeograph, simple stencil printer, digital stencil printer or similar stencil printer.

Preferred embodiments of the stencil printer in accordance with the present invention will be described hereinafter. In the illustrative embodiments, the same or similar structural elements are designated by like reference numerals, but distinguished by suffixes A and B.

1st Embodiment

Figure 3:
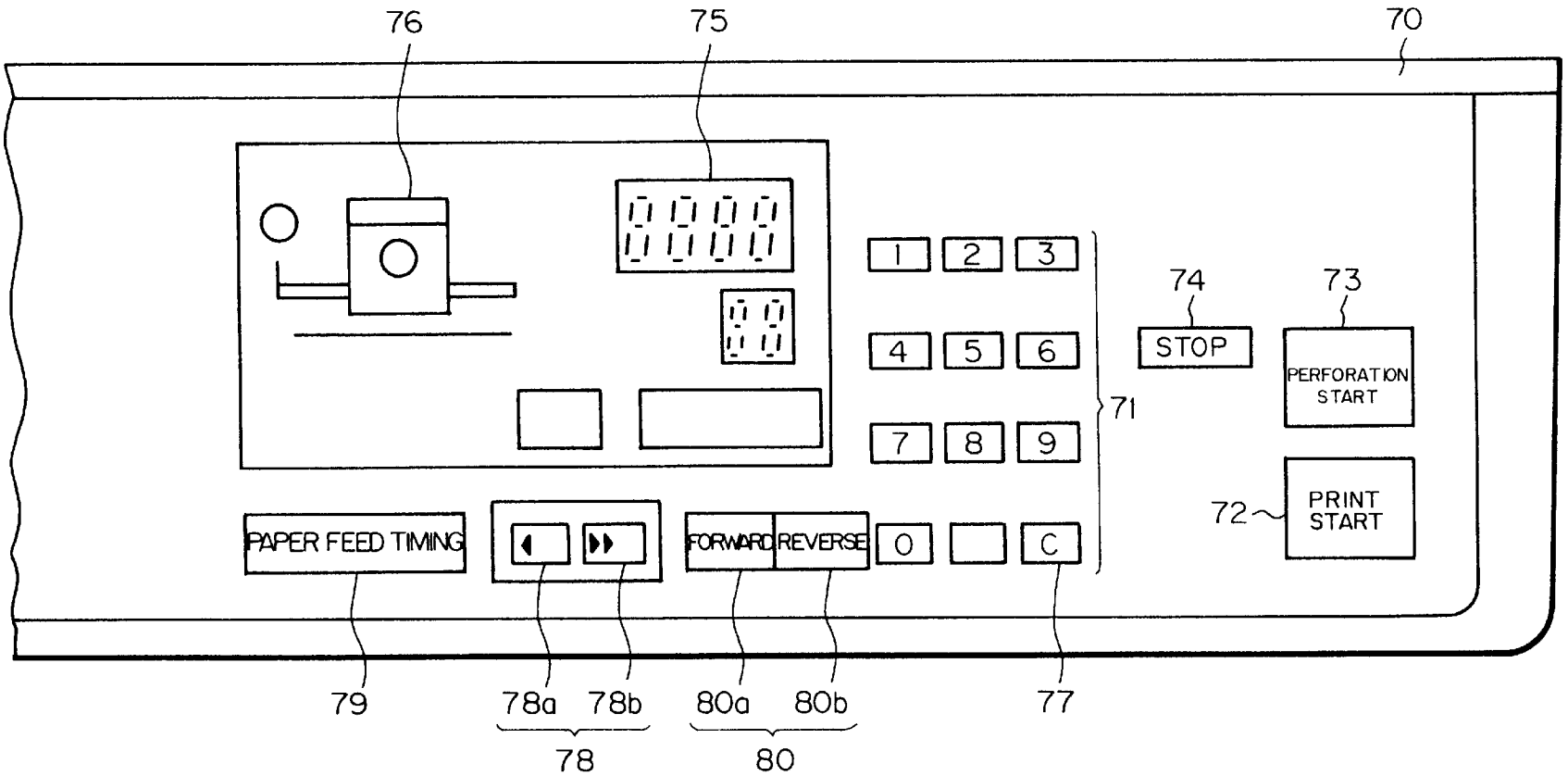
FIG. 3 is a fragmentary plan view showing an operation panel applicable to the first embodiment, its modification and a second embodiment of the present invention.

Referring to FIG. 1 of the drawings, a stencil printer embodying the present invention is shown and implemented as a digital stencil printer. FIG. 3 shows an operation panel or operating section 70 mounted on the printer. When a perforation start key 73 provided on the operation panel 70 is pressed, a step of peeling off a used master from the outer periphery 3*a* of an ink drum 3 and a step of making and feeding a master are executed in parallel. In the master masking and feeding step, master making and feeding means 2 perforates, or cuts, a stencil in accordance with image data output from document reading means 1 and representative ol a document, while feeding the stencil toward the ink drum 3. The document reading means 1 is arranged in the upper portion of the printer. The perforated part of the stencil or master is clamped by a clamper 4 mounted on the ink drum 3. Then, the drum 3 is rotated clockwise, as viewed in FIG. 1, so that the master is wrapped around the ink drum 3.

A paper 19 is fed from a paper feed section 6 by a paper feed device 8. A paper conveyor 9 includes an endless belt 14. The belt 14 is charged by charging means 13 in order to cause the paper 19 to electrostatically adhere thereto. The belt 14 conveys the paper 19 toward a paper discharge section 12 via a print section 11 where the outer periphery 3*a* of the ink drum 3 and a press roller 10 face each other. The press roller or pressing means 10 is movable into and out of contact with the ink drum 3. At the print section 11, the paper 19 is pressed between the press roller 10 and the ink drum 3 with the result that ink is transferred from the inside of the ink drum 3 to the paper 19 via the perforations of a master 5, forming an image on the paper 19. While the belt 14 conveys the paper with the image, i.e., a printing toward the paper discharge section 12 while electrostatically retaining it thereon, discharging means discharges the belt 14 to cancel the electrostatic adhesion. As a result, the printing 19 is separated from the belt 14. Finally, the printing 19 is driven out of the printer to a tray 17 by a paper discharge device 16 constituting the paper discharge section 12. Master discharging means 18 peels off a used master from the outer periphery 3*a* of the ink drum 3.

Figure 2:
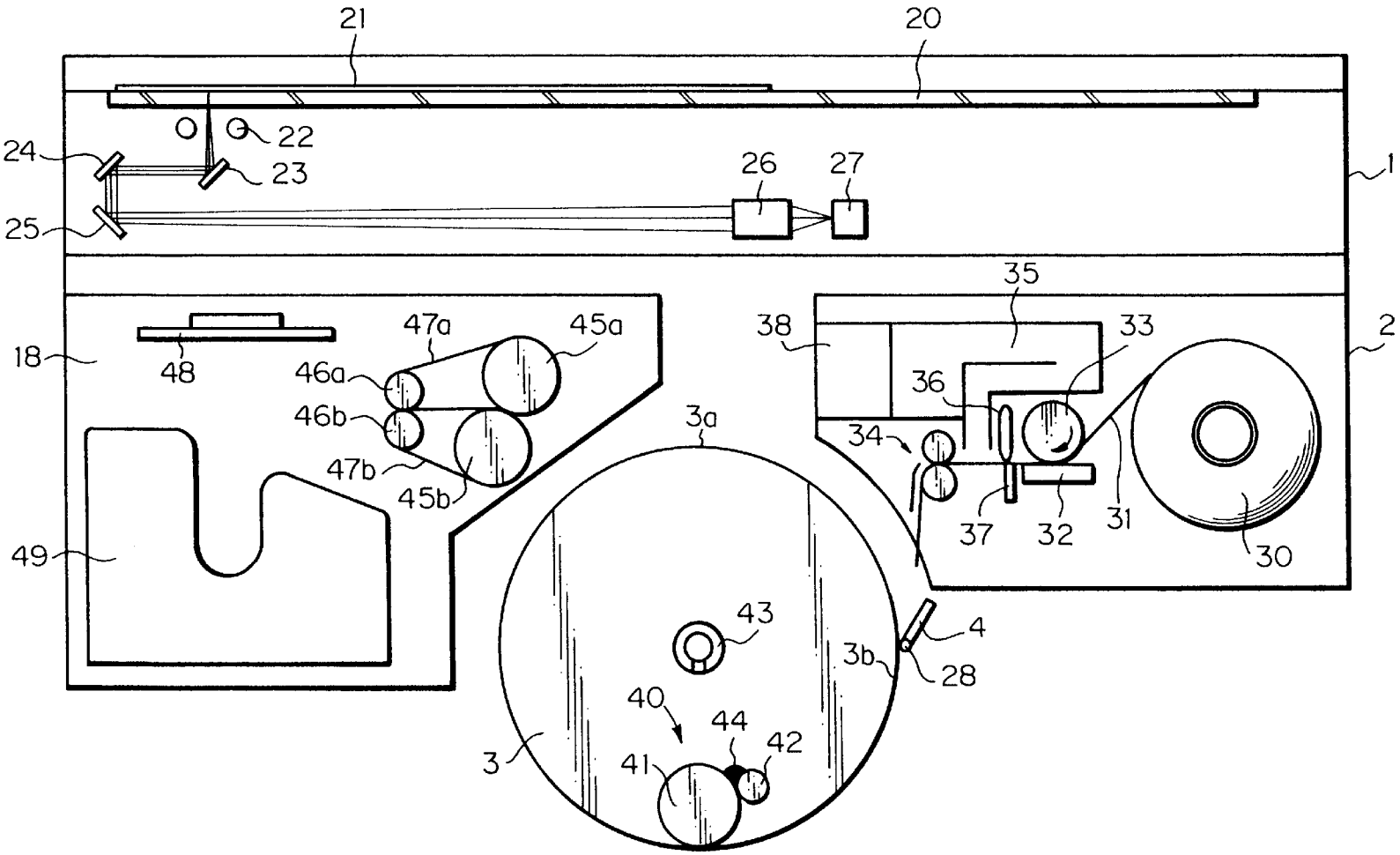
FIG. 2 shows document reading means, master making and feeding means, master discharging means and the inside of an ink drum included in the first embodiment specifically.

As shown in FIG. 2, the document reading means 1 reads a document 21 laid on a glass platen 20 and is implemented as so-called reduction optics. Specifically, while a light source 22 illuminates the document 21, the resulting image-wise reflection from the document 21 is incident to a CCD (Charge Coupled Device) image sensor 27 via a first mirror 23, a second mirror 24, a third mirror 25, and a lens 26. The CCD image sensor 27 transforms the incident light to a corresponding electric image signal. Then, the image signal is digitized by an image processor not shown.

The master making and feeding means 2 is positioned below the document reading means 1 in one side portion of the printer body. The master making and feeding means 2 includes a thermal head 32 having a number of heating elements, not shown, arranged in an array thereon. The heating elements are selectively energized in accordance with the digital image signal output from the image processor. A stencil 31 is paid out from a roll 30 to a nip between the thermal head 32 and a platen roller 33 facing the head 32. The stencil 31 has a laminate structure made up of a porous support and an extremely thin thermoplastic resin film adhered to the support. The porous support is a mixture of Japanese paper and synthetic fibers while the resin film is formed of polyester easy to perforate.

The stencil 31 is pressed against the thermal head 32 by the platen roller 33 and selectively perforated by heat in accordance with the image signal. The platen roller 33 is rotated clockwise, as viewed in FIG. 2, so that the stencil 31 is conveyed to the left, as viewed in FIG. 2, while being perforated. The leading edge of the stencil 31 is nipped by a turn roller pair 34. The stencil 31 being conveyed is temporarily received in a loop box 35 due to the operation of a fan 38 disposed in the box 35.

When the clamper 4 mounted on the ink drum 3 is brought to a preselected position, the turn roller pair 34 is driven to convey the leading edge of the perforated stencil 31 toward the clamper 4, pulling the stencil 31 out of the loop box 35. When a single master is completed, a cutter made up of a rotary edge 36 and a stationary edge 37 cuts the stencil 31 at a preselected length, thereby producing a single master 5.

The ink drum 3 has an inner periphery implemented by a thin porous sheet formed with a number of pores for allowing ink to pass therethrough. The porous sheet is formed of stainless steel and provided with a hollow cylindrical configuration. A porous elastic layer is wrapped around the porous sheet and implemented as a mesh screen, not shown, which is a fabric of chemical fibers. The ink drum 3 is rotatably mounted on an ink feed shaft 43 and positioned at the center of the printer body. The ink drum 3 is rotatable in to opposite directions by being driven by a drum drive section which will be described later specifically.

An ink feed device or ink feeding means 40 is arranged in the ink drum 3 and includes an ink roller 41 and a doctor roller 42. The ink roller 41 feeds ink to the inner periphery 3*b* of the ink drum 3. The doctor roller 42 extends in parallel to the ink roller 41 and is spaced from the roller 41 by a small gap, forming an ink well 44 between the rollers 42 and 41. An ink pack, not shown, is positioned at a suitable location. An ink pump, not shown, feeds ink under pressure from the ink pack to a distributor, not shown, via the ink feed shaft 43. The distributor distributes the ink to the rear in the direction perpendicular to the sheet surface of FIG. 2, thereby delivering the ink to the ink well 44. The ink flows along the surface of the ink roller 41 and is fed to the inner periphery 3*b* of the ink drum 3 in an optimal amount. Measuring means, not shown, measures the amount of ink to be fed to the ink well 44 while the ink pump controls the delivery of the ink on the basis of the measured amount. In the illustrative embodiment, the ink is implemented by emulsion ink.

The ink roller 41 is formed of aluminum or similar metal and rotated clockwise, as viewed in FIG. 2, together with the drum 3 via a gearing, not shown. The ink roller 41 may be formed of rubber, if desired. The peripheral speed of the ink roller 41 and that of the ink drum 3 have a preselected ratio. The doctor roller 42 is formed of iron, stainless steel or similar metal and rotated counterclockwise via a gearing, not shown. The peripheral speed of the doctor roller 42 and that of the ink drum 3 also have a preselected ratio.

The clamper 4 mounted on the outer periphery 3*a* of the ink drum 3 is rotatable about a shaft 28 toward and away from the periphery 3*a* by being driven by a mechanism, not shown. The clamper 4 is held in its closed position while the ink drum 3 is in rotation, but caused to open and then close when a used master is to be removed from the drum 3 or when the new master 5 is to be wrapped around the drum 3. Specifically, when the ink drum 3 is caused to stop rotating at a preselected position after the discharge of a used master, the clamper 4 is opened in order to receive the leading edge of the master 5 to be fed from the master making and feeding means 2. Then, the clamper 4 is closed about the shaft 28 at the time when the leading edge of the master 5 arrives at the clamper 4, thereby clamping the master 5. Subsequently, the ink drum 3 is rotated clockwise until the master 5 has been fully wrapped around its outer periphery 3*a*.

The master discharging means 18 for removing a used master from the drum 3 includes a master peeling and conveying section having driven rollers 45*a* and 45*b* and drive rollers 46*a* and 46*b* cooperating with the driven rollers 45*a* and 45*b*, respectively. Belts 47*a* and 47*b* are respectively passed over the drive roller 46*a* and driven roller 45*a* and the drive roller 46*b* and driven roller 45*b*. A waste master box 49 is positioned below the downstream side of the peeling and conveying section. A presser 48 is positioned above the waste master box 49 and movable up and down. When the perforation start key 73, FIG. 3, is pressed, the ink drum 3 is rotated counterclockwise to convey the trailing edge of a used master wrapped therearound toward the driven roller 45*a*. When the used master approaches the driven roller 45*a*, the driven roller 45*b* is angularly moved about the shaft of the driven roller 45*a* while being rotated. On contacting the outer periphery 3*a* of the ink drum 3, the driven roller 45*b* picks up the trailing edge of the used master and takes it in cooperation with the driven roller 45*a*. The ink drum 3 is continuously rotated counterclockwise. As a result, the used master is sequentially peeled off from the outer periphery 3*a* of the ink drum 3 due to the rotation of the ink drum 3 and the operation of the peeling and conveying section.

The used master brought into the master discharging means 18 is introduced into the waste master box 49. After the entire used master has been received in the box 49, the presser 48 is lowered in order to compress the used master. Thereafter, the presser 48 is again raised to its preselected position.

Referring again to FIG. 1, the paper feed device 8 is positioned closer to a paper tray 7 than the print section 11, i.e., upstream of the print section 11 in the direction in which the paper 19 is conveyed during forward rotation, as indicated by an arrow a. Let this direction a referred to as a direction of paper conveyance a hereinafter. Papers 19 are stacked on the paper tray 7 and sequentially fed to the the print section 11. The paper feed device 8 includes a pick-up roller 50, a feed roller pair 51, i.e., an upper feed roller 51*a* and a lower feed roller 51*b*, a stop plate 52, and a registration roller pair 53, i.e., an upper registration roller 53*a* and a lower registration roller 53*b*. When the operator inputs a desired number of printings on numeral keys 71, FIG. 3, and then presses a print start key 72, FIG. 3, the pick-up roller 50 and feed roller pair 51 start rotating clockwise at a preselected timing. The upper feed roller 51*a*, lower feed roller 51*b* and stop plate 52 cooperate to feed the top paper 19 on the tray 7 toward the registration roller pair 53 while separating it from the underlying papers.

The upper registration roller 53*a* is driven by a registration motor 29 which will be described. The lower registration roller 53*b* is held in contact with the upper registration roller 53*a*. The registration roller pair 53 is rotated at such a timing that the leading edge of the paper 19 meets the leading edge of the perforated area or image area of the master 5 at the print section 11.

The pick-up roller 50, feed roller pair 51 and lower registration roller 53*b* each is formed of urethane rubber. Alternatively, use may be made of solid or foam rollers formed of natural rubber, chloroprene rubber, nitril rubber, EDPM, butadien rubber, styrene butadien rubber or silicone rubber. The pick-up roller 50, feed roller pair 51 and lower registration roller 53*b* may advantageously be provided with a rubber hardness ranging from 20 degrees to 70 degrees, as prescribed by JIS-A.

The upper registration roller 53*a* is formed of a plastic, preferably polyacetal, nylon, polybuthylene terephthalate, polycarbonate or polyphenylene sulfite. The plastic may be replaced with iron, iron plated with nickel or chromium, or stainless steel or aluminum alloy.

The belt conveyor 9 conveys the paper 19 fed from the registration roller pair 53 at a preselected timing, while causing it to electrostatically adhere thereto. As shown in FIG. 1, the belt 14 is passed over a drive roller 59 closer to the paper discharge section 12 than the print section 11, and a driven roller 60 close to the registration roller pair 53. The belt 14 is held under tension such that its upper run extends through the print section 11. The belt 14 is a seamless belt formed of a material having a medium resistance (volume resistivity between $10^7$ Ωcm and $10^{12}$ Ωcm) and capable of being easily charged by the charging means 13 and discharged by the discharging means 15. The drive roller 59 and driven roller 60 have the same diameter and are positioned such that horizontal lines tangential to the rollers 59 and 60 are coincident, as indicated by G in FIG. 1. The driven roller 60 is a so-called tapered roller tapered at its axially opposite ends; the belt 14 is positioned at substantially the center of the roller 60. Of course, the diameter of the drive roller 59 and that of the driven roller 60 may be different from each other.

A pulley 61 is affixed to the shaft 59*a* of the drive roller 59. A drive belt 64 is passed over the pulley 61 and a drive pulley 63 affixed to the output shaft 62*a* of a reversible belt motor 62. The belt 14 is driven such that its outer surface 14*a* moves at the same peripheral speed as the outer periphery 3*a* of the ink drum 3. The counterclockwise rotation of the belt 14 and the clockwise rotation of the same will be referred to as forward rotation and reverse rotation, respectively.

The press roller 10 movable into and out contact with the outer periphery 3*a* of the ink drum 3 at a position where it faces the ink roller 41, forming the print section 11 in cooperation with the ink drum 3. The press roller 10 protrudes above the previously mentioned common tangential line G and presses the paper 19 against the drum 3 via the belt 14.

Figure 4:
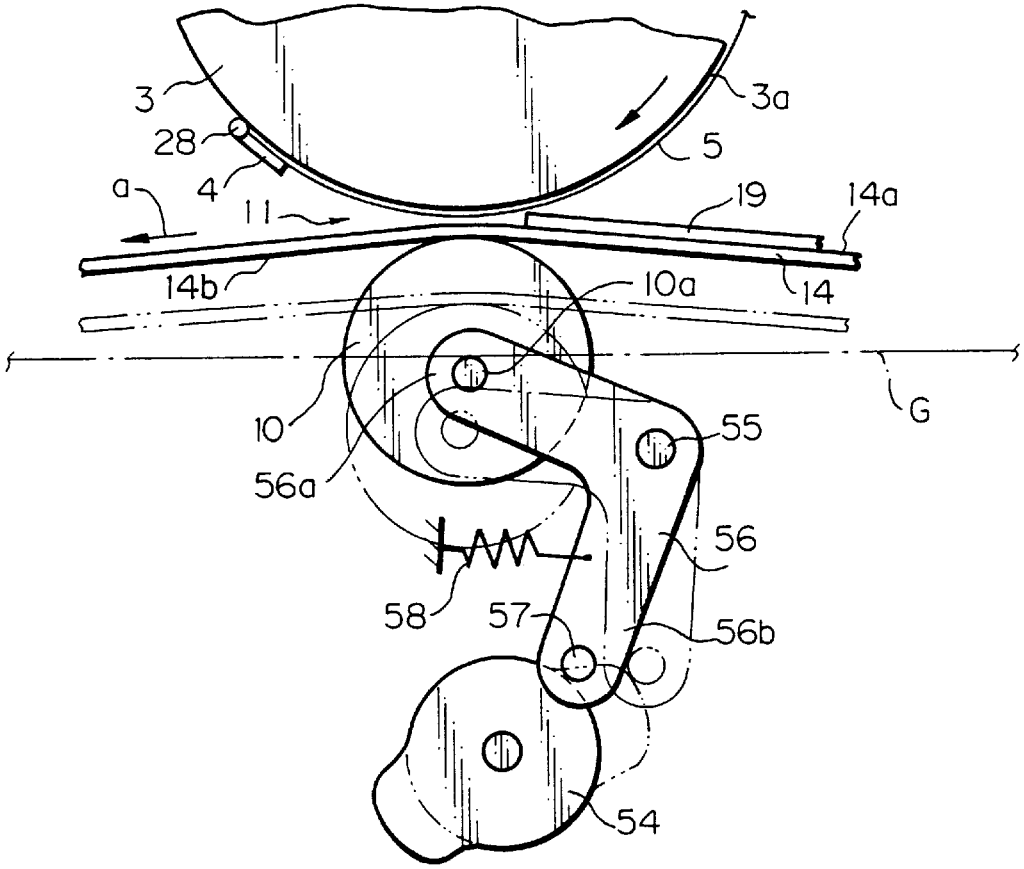
FIG. 4 shows a press roller moving mechanism included in the first embodiment and its modification together with the operation of the mechanism and a paper about to enter a print section.

Specifically, as shown in FIG. 4, a generally L-shaped press roller arm 56 is rotatable about a shaft 55. The press roller 10 is rotatably mounted on one end 56*a* of the press roller arm 56 via a shaft 10*a* and movable into and out of contact with the outer periphery 3*a* of the ink drum 3. A tension spring 58 is anchored to the other end portion 56*b* of the arm 56 so as to constantly bias the press roller 10 toward the drum 3. A cam follower 57 is mounted on the end 56*b* and pressed against the contour of a cam 54 by the spring 58.

The cam 54 has a larger diameter portion and a smaller diameter portion and is rotatable in synchronism with the paper feed timing from the registration roller pair 53 and the rotation of the ink drum 3. When the paper 19 is not fed from the registration roller pair 53, the larger diameter portion of the cam 54 faces the cam follower 57, spacing the press roller 10 from the ink drum 3. On the feed of the paper 19 from the registration roller pair 53, the smaller diameter portion of the cam 54 faces the cam follower 57 and causes the press roller 10 to rise toward the ink drum 3 in the clockwise direction, as viewed in FIG. 1.

As shown in FIG. 4, in the above configuration, the press roller 10 is constantly pressed against the inner surface 14*b* of the belt 14, causing the belt 14 to protrude upward toward the outer periphery 3*a* of the ink drum 3. The outer surface 14*a* of the belt 14 positioned at the print section 11 side forms a paper transport path.

As shown in FIG. 1, the charging means 13 includes a charger 65 and a high-tension power source 66. The charger 65 is located at a position adjoining the circumferential surface of the driven roller 60 and upstream, in the direction of paper conveyance a, of a position A where the paper 19 begins to electrostatically adhere to by the belt 14. The charger 65 is implemented as a non-contact type corotron charger effecting corona discharge. The high-tension power source 66 is a DC power source applying a charge bias to the charger 65.

The discharging means 15 includes a discharger 67 and a high-tension power source 68. The discharger 67 is located at a position adjoining the circumferential surface of the drive roller 59 and upstream, in the direction of paper conveyance a, of a position B where the paper 19 is separated from the belt 14 due to the curvature of the roller 59 and the elasticity of the paper 19 itself. The discharger 67 is also implemented by a non-contact type corotron discharger effecting corona discharge. The high-tension power source 68 is a DC power source applying a discharge bias to the discharger 67. This discharge bias is opposite in polarity to the charge bias applied to the charger 65.

The paper discharge device 16 intervenes between the tray 17 and the above position B for conveying the paper or printing 19 transferred thereto from the belt 14 to the tray 17. Specifically, a porous belt 84 is passed over a drive roller 82 adjoining the tray 17 and a driven roller 83 adjoining the position B. A suction fan 85 is positioned below the belt 84. The belt 84 is formed of, e.g., rubber having a great coefficient of friction and caused to rotate counterclockwise, as viewed in FIG. 1, at a higher peripheral speed than the ink drum 3. The suction fan 85 is driven in synchronism with the paper discharge device 16 by a fan drive section which will be described later, causing the outer surface or conveying surface of the belt 84 to exert a sucking force.

A separator 86 is positioned between the drive roller 59 and the driven roller 83 in the vicinity of the belt 14. The separator 86 is spaced from the outer surface 14*a* of the belt 14 by a small gap. The separator 86 promotes the separation of the paper 19 from the belt 14 at the position B while preventing the paper 19 from rolling up.

A jump platform 87 is positioned above, but in the vicinity of, the portion of the belt 84 adjoining the tray 17. The jump platform 87 separates the paper or printing 19 from the belt 84 and guides it to a position above the tray 17.

As shown in FIG. 3, various keys are arranged on the operation panel 70. The numeral keys 71 are used to input a desired number of printings. The print start key 72 is pressed to cause a sequence of steps up to an actual printing step to start. The perforation start key 73 is pressed to cause a procedure for reading an image, making a master, feeding the master and producing a trial printing to start. A stop key 74 is used to interrupt any one of such operations. A display 75 is implemented by LEDs (Light Emitting Diodes) for displaying, e.g., the number of printings input on the numeral keys 71. A display 76 is implemented by an LCD (Liquid Crystal Display) for displaying the location and content of a jam caused by the master or the paper 19 or similar error. A clear key 77 is used to clear, e.g., the number of printings input on the numeral keys 71. A paper feed timing select key 79 is used to change a paper feed timing. Paper feed timing adjust keys 78, i.e., a down key 78*a* and an up key 78*b* are accessible for variably adjusting a paper feed timing stepwise. Rotation direction select keys or selecting means 80, i.e., a forward key 80*a* and a reverse key 80*b* are used to switch the direction of movement of the belt 14. The rotation direction select keys 80 are not used in this embodiment.

Figure 6:
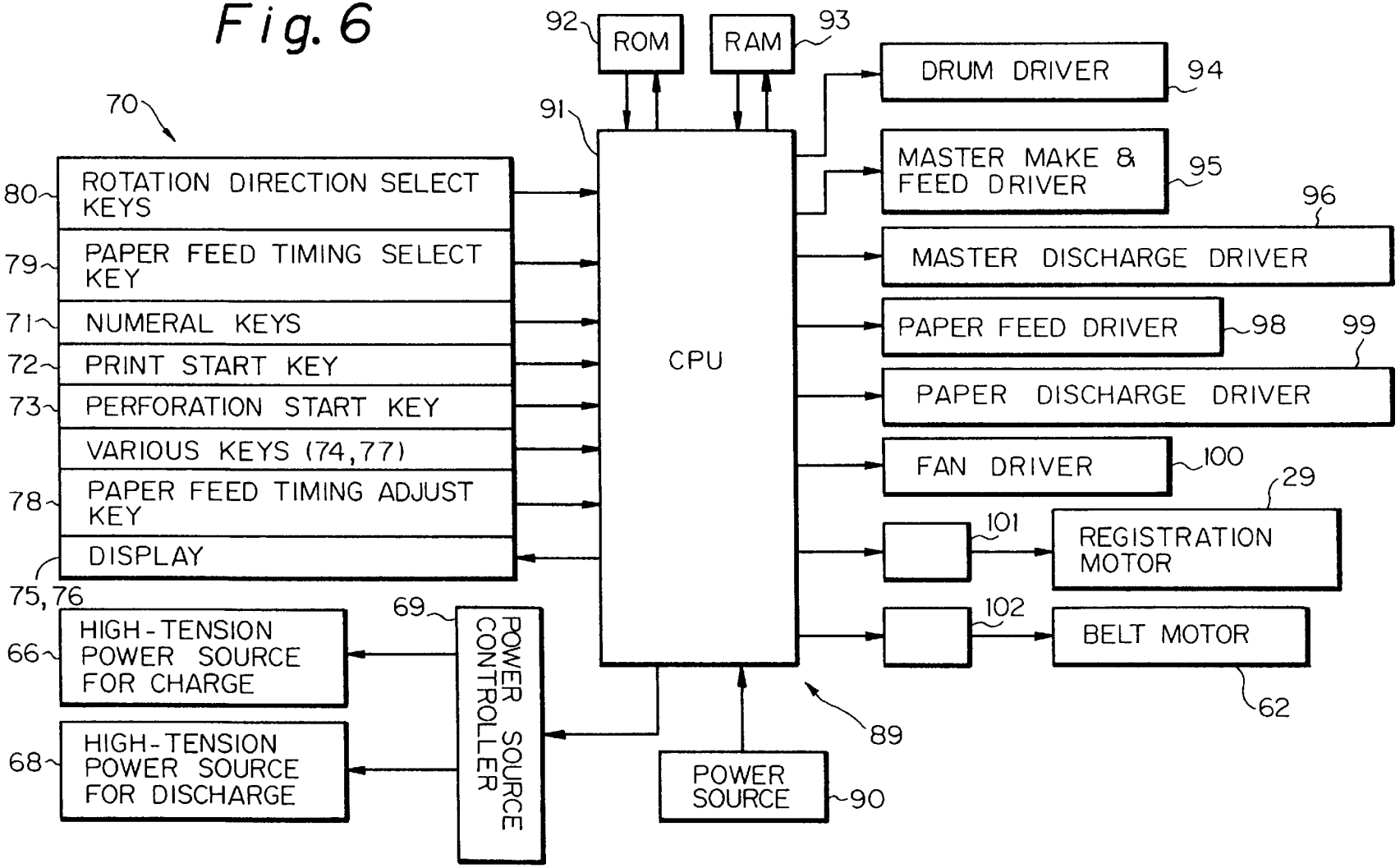
FIG. 6 is a block diagram schematically showing a control system included in the first embodiment and its modification.

As shown in FIG. 6, the high-tension power sources 66 and 68 for charging and discharging, respectively, are electrically connected to a power source controller 69. The power source controller 69 is, in turn, electrically connected to a CPU (Central Processing Unit) 91 constituting control means 89.

The control means 89 is implemented by a conventional microcomputer including, in addition to the CPU 91, an I/O (Input/Output) port, not shown, a ROM (Read Only Memory) 92, a RAM (Random Access Memory) 93 which are interconnected by a signal bus, not shown. The CPU 91 is electrically connected to the various keys and displays arranged on the operation panel 70 so as to interchange command signals and/or ON/OFF signals and data signals therewith.

The CPU 91 is electrically connected to a drum driver 94 for reversibly rotating the ink drum 3, a master make and feed driver 95 for driving the master making and feeding means 2, a master discharge driver 96 for driving the master discharging means 18, a paper feed driver 98 for driving the paper feed device except for the registration roller pair 53, and a fan driver 100 for driving the suction fan 85 so as to interchange command signals and/or ON/OFF signals and data signals therewith. In this configuration, the CPU 91 controls the operation of the entire printer including the start and stop of each device and driver as well as timings.

The registration motor 29 and belt motor 62 are connected to the CPU 91 via drivers 101 and 102, respectively. The CPU 91 is capable of controlling the drive conditions of the motors 29 and 62, i.e., the paper feed timing and the direction of rotation of the belt 14. The results of computation of the CPU 91 are temporarily written to the RAM 93 and read thereoutof, as needed.

The ROM 92 stores data necessary for the start and stop of each device and driver as well as timings beforehand. Specifically, there is stored in the ROM 92 a program for causing, when the perforation start key 73 is pressed, the master making, master discharging and trial printing procedure to occur and for causing, when the print start key 72 is pressed, the paper feeding, printing and paper discharging procedure to repeatedly occur a number of times corresponding to the number of printings input on the numeral keys 71. When the ink drum 3 starts rotating in response to the operation of the perforation start key 73 or the print start key 72, the above program drives the high-tension power sources 66 and 68.

The operation of the illustrative embodiment will be described hereinafter. Because the master making and feeding step and master discharging step have already been described specifically, the following description will concentrate on the feed of the paper 19, including one for trial printing, and the actual printing, separation conveyance and discharge effected with the paper 19.

While the master feeding step ends when the master 5 is fully wrapped around the ink drum 3, the drum 3 is continuously rotated clockwise to start a trial printing step including the feed of the paper 19. When the ink drum 3 is rotated, the belt motor 62 is driven to cause the belt 14 to move counterclockwise at the same peripheral speed as the drum 3.

In the paper feed device 8, the pick-up roller 50 and upper feed roller 51*a* are rotated clockwise in synchronism with the ink drum 3. The feed roller pair 51 and stop plate 52 cooperate to feed only the top paper 19 from the tray 7 toward the registration roller pair 53 which is in a halt at that time. At the same time, the charger 65 charges the belt 14. Because the driven roller or electrode 60 faces the charger 65, a charge bias from the charger 65 is pulled toward the belt 14 by the electrode 60. This allows the belt 14 to be stably charged. The registration roller pair 53 conveys the paper 19 toward the print section 11 at such a timing that the leading edge of the paper 19 meets the leading edge of the image area of the master 5 wrapped around the drum 3.

When the paper 19 approaches the previously stated position A, it hangs down due to its own weight and contacts the outer surface 14*a* of the belt 14. As a result, the paper 19 is electrostatically adhered to the outer surface 14*a* of the belt 14 due to the charge deposited by the charger 65. As the belt 14 conveys the paper 19 toward the print section 11, the area over which the paper 19 is electrostatically adhered to the belt 14 sequentially increases. Consequently, electrostatic adhesion between the paper 19 and the belt 14 sequentially increases as the paper 19 is conveyed toward the print section 11, stabilizing the position of the paper 19 on the belt 14.

At the above stage of operation, the press roller 10 is spaced from the outer periphery 3*a* of the ink drum 3, as indicated by a dash-and-dots line in FIG. 4. When the leading edge of the paper 19 approaches the print section 1, the cam 54 rotating in synchronism with the ink drum 3 cooperates with the cam follower 57 to raise the press roller 10 to a position indicated by a solid line in FIG. 4. As a result, the press roller 10 is pressed against the outer periphery 3*a* of the ink drum 3. The paper 19 is smoothly introduced into the print section 11 because it is sufficiently electrostatically adhered to the belt 14.

The press roller 10 is constantly pressed against the inner surface 14*b* of the belt 14 even when it is released from the ink drum 3. Therefore, when the belt 14 starts rotating counterclockwise, the press roller 10 also starts rotating in the same direction and at the same peripheral speed as the belt 14. It follows that despite the upward movement of the press roller 10, the peripheral speed of the press roller 10 or that of the belt 14 does not change. This successfully prevents the belt 14 from slackening or oscillating.

Assume that the press roller 10 does not contact the inner surface 14*b* of the belt 14 when spaced from the ink drum 3. Then, the press roller 10 held stationary will contact the belt 14 being rotated for the first time when starting to rise. The transition of the press roller 10 from the stop to the rotation at the peripheral speed of the belt 14 brings about acceleration and therefore a moment of inertia, causing the belt 14 to slack or oscillate. This is likely to separate the paper 19 from the belt 14 or to dislocate the paper 19 on the belt 14.

Figure 5:
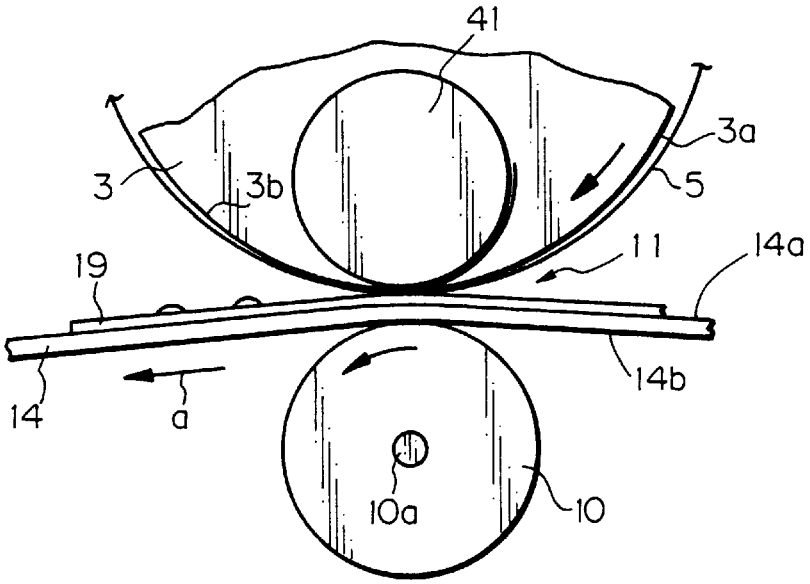
FIG. 5 shows how the paper is passed through the print section.

As shown in FIG. 5, on the entry of the paper 19 into the print section 11, the ink fed to the inner periphery 3*b* of the ink drum 3, i.e., the cylindrical porous thin sheet is passed through the pores of the above sheet due to the action of the press roller 10. The ink passed through the pores of the sheet is spread by the mesh screen, then evenly spread by the porous support of the master 5, and then transferred to the paper 19 via the perforations formed in the film of the master 5. As a result, an image represented by the perforations of the master 5 is printed on the paper 19. The paper 19 with the image is further conveyed to the downstream side in the direction of paper conveyance a. At this instant, because the press roller 10 is pressed against the inner surface 14*b* of the belt 14, the belt 14 is free from slacking or oscillation and stably retains the paper 19 thereon. The portion of the belt 14 downstream of the print section 11 in the direction of paper conveyance a is inclined away from the print section 11 due to the positional relation between the press roller 10 and the drive roller 59. It follows that the paper 19 with the image is firmly electrostatically retained on the belt 14 and prevented from wrapping around the master 5 despite the absence of a separator around the ink drum 3. Consequently, the paper or printing 19 is free from marks ascribable to a separator.

When the leading edge of the printing 19 is brought to a position beneath the discharger 67, FIG. 1, by the belt 14, the discharger 67 discharges the belt 14 and printing 19 and thereby cancels electrostatic adhesion between the printing 19 and the belt 14. In this manner, the entire printing 19 and entire belt 14 moving below the discharger 67 are discharged.

The printing 19 discharged by the discharger 67 arrives at the position B where the belt 14 is curved due to the curvature of the drive roller 59. As a result, at the position B, the printing 19 is separated from the belt 14 due to its own elasticity and the curvature of the belt 14. The leading edge of the printing 19 separated from the belt 14 is guided by the separator 86 to the belt 84 located downstream of the belt 14 in the direction of paper conveyance a.

The printing 19 transferred from the belt 14 to the belt 84 is conveyed by the belt 84, which is rotating counterclockwise, while being retained on the belt 84 by the sucking force of the fan 85 and friction acting between the printing 19 and the belt 84. The belt 84 is caused to move at a higher peripheral speed than the outer periphery 3*a* of the ink drum 3, i.e., the belt 14. Therefore, when the trailing edge of the paper 19 moves away from the print section 11, it is accelerated to the peripheral speed of the belt 84. The printing 19 is conveyed to the jump platform 87 by the belt 84 while being retained thereon by the suction fan 85. Then, the printing 19 is separated from the belt 84 by the jump platform 87 and caused to jump into the tray 17. As a result, the printing 19 hits against an end plate included in the tray 17 and then drops to be stacked on the bottom of the tray 17.

In the case of trial printing, the above paper feeding, printing, separating, conveying and discharging procedure occurs after the feed of a master. In the case of actual printing, the same procedure occurs when the operator inputs a desired number of printings on the numeral keys 71 and then presses the print start key 72. As for actual printing, such a procedure is repeated a number of times corresponding to the desired number of printings; the ink drum 3 stops rotating at a preselected position when the desired number of printings are output.

It may occur that the operator desires to shift the position of an image on the paper 19 or that the image cannot be printed on the paper 19 at a preselected position due to an error occurred in the control system. In such a case, the operator presses the key 79 to set up a manual mode in the control system and then presses the up key 78*b* or the down key 78*a*. When the up key 78*b* or the down key 78*a* is pressed, the CPU 91 advances or delays, respectively, the timing for driving the registration motor 29 via the driver 101. As a result, the timing for feeding the paper 19 is shifted in the direction of paper conveyance a. This allows an image to be printed on the paper 19 at any desired position or frees an image from dislocation.

Figure 7:
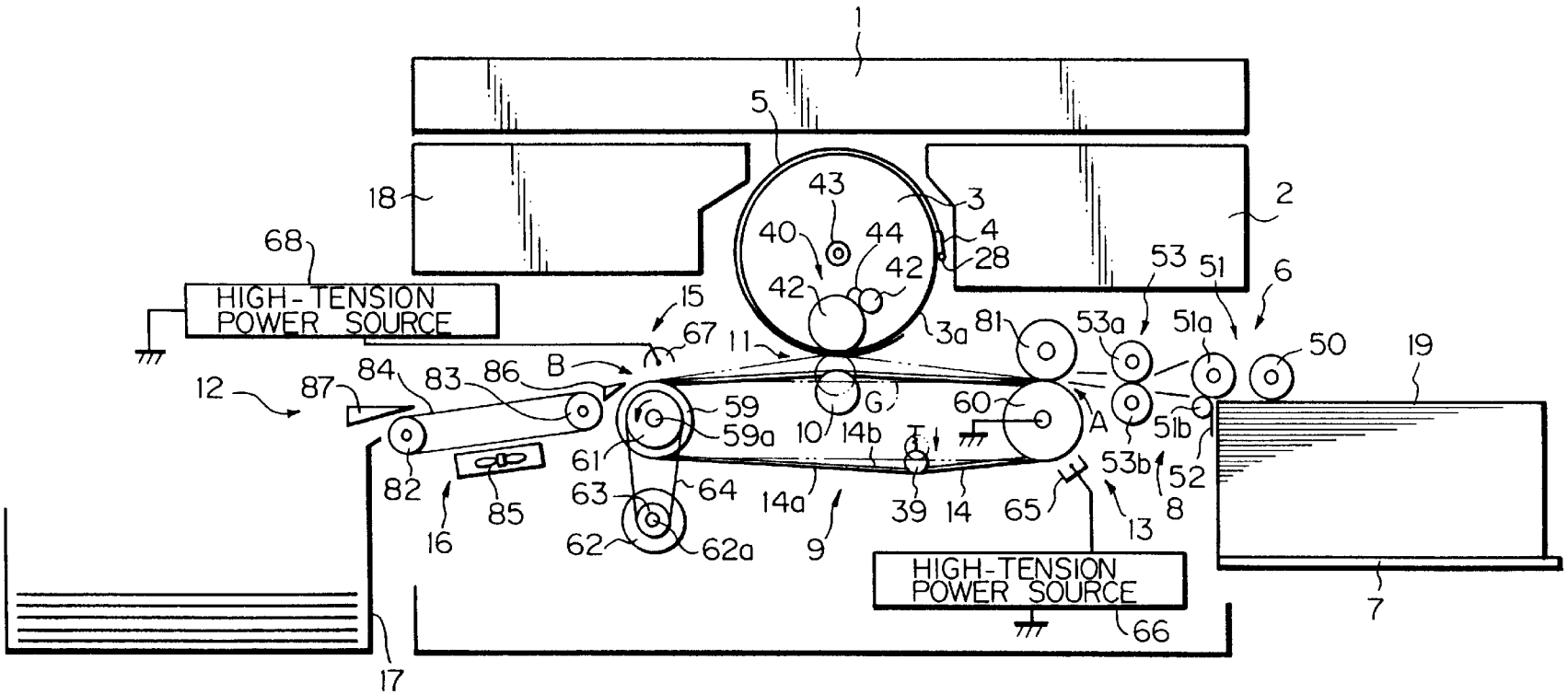
FIG. 7 shows the modification of the first embodiment.

In the illustrative embodiment, the belt 14 is passed over the drive roller 59 and driven roller 60 under preselected tension. Alternatively, as shown in FIG. 7, a tension roller 39 may be pressed against the inner surface 14*b* of the belt 14 at a position not interfering with the transport of the paper 19 between the position B and the charger 65. The tension roller 39 applying tension to the belt 14 will more positively prevent the belt 14 from slackening and will thereby further reduce the dislocation of an image on the paper 19.

As also shown in FIG. 7, a rotatable press roller 81 for pressing the paper 19 may be located to face the driven roller 60 over which the belt 14 is passed. The press roller 81 is so positioned as to contact the outer surface 14*a* of the belt 14 at the position A. While the press roller 81 is shown as being simply contacting the outer surface 14*a* of the belt 14, it may be pressed against the surface 14*a* by a tension spring, not shown, leaf spring or similar biasing means. In any case, at the position A, the press roller 81 and the belt 14 nip the paper 19 fed from the registration roller pair 53. Consequently, the paper 19 is pressed against the belt 14. This further stabilizes the electrostatic adhesion of the paper 19 to the belt 14 and therefore the conveyance of the paper 19 for thereby enhancing image quality.

2nd Embodiment

Figure 8:
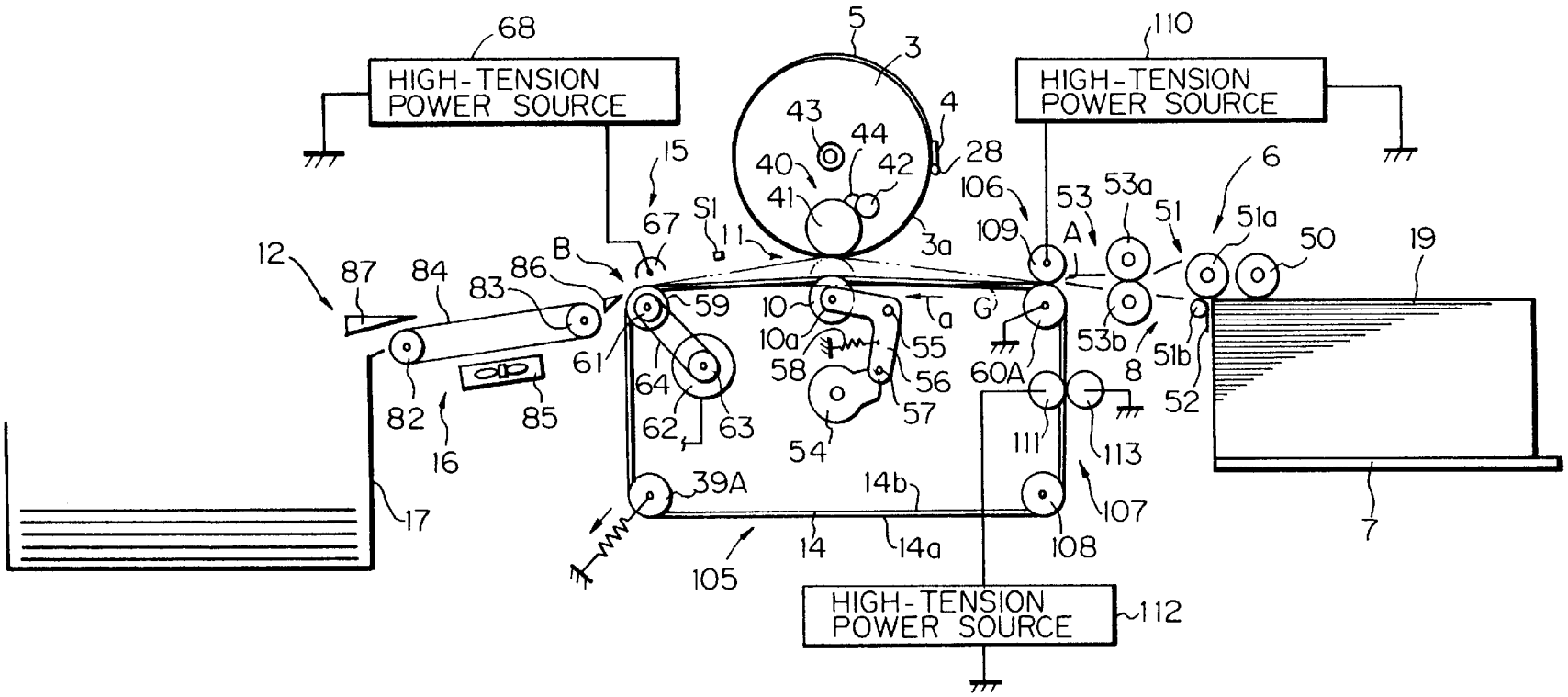
FIG. 8 shows a second embodiment of the stencil printer in accordance with the present invention.

FIG. 8 shows a second embodiment of the present invention. As shown, the second embodiment is similar to the first embodiment except for a belt conveyor 105 and charging means 106. This embodiment includes belt discharging means 107 for discharging the belt 14 from which the paper 19 has been separated, and a paper sensor or paper sensing means SI for sensing a condition in which the paper 19 is conveyed.

The belt conveyor 105 conveys the paper 19 fed from the registration roller pair 53 at the preselected timing, while electrostatically retaining it thereon. The belt 14 is passed over the drive roller 59, a driven roller 60A, a tension roller 39A and a driven roller 108 such that it extends through the print section 11. The drive roller 59 is positioned closer to the paper discharge section 12 than the print section 11. The driven roller 60A is positioned in the vicinity of the registration roller pair 53.

The tension roller 39A and driven roller 108 each is a drum-like roller member having a preselected diameter and prevents the belt 14 from being dislocated. The tension roller 39A and driven roller 108 are positioned below the drive roller 59 and driven roller 60A, respectively. The drive roller 59 and driven roller 108 diagonally face each other, and so do the tension roller 39A and driven roller 60A. The belt 14 is therefore runs along a substantially rectangular path.

Particularly, the drive roller 59 and driven roller 60A are positioned such that horizontal lines tangential to the rollers 59 and 60A, respectively, coincide with each other on the common tangential line G. The driven roller 60A has a medium resistance and formed of natural rubber in which aluminum and a conductive filler are dispersed. The driven roller 60A constitutes an electrode facing the charging means 106.

The belt conveyor 105 is driven by the belt motor 62, pulleys 61 and 63 and belt 64 such that the belt 14 moves at the same peripheral speed as the outer periphery 3*a* of the ink drum 3, as in the first embodiment. In the belt conveyor 105, the counterclockwise rotation and the clockwise rotation of the belt 14 are assumed to be forward rotation and reverse rotation, respectively.

Figure 9:
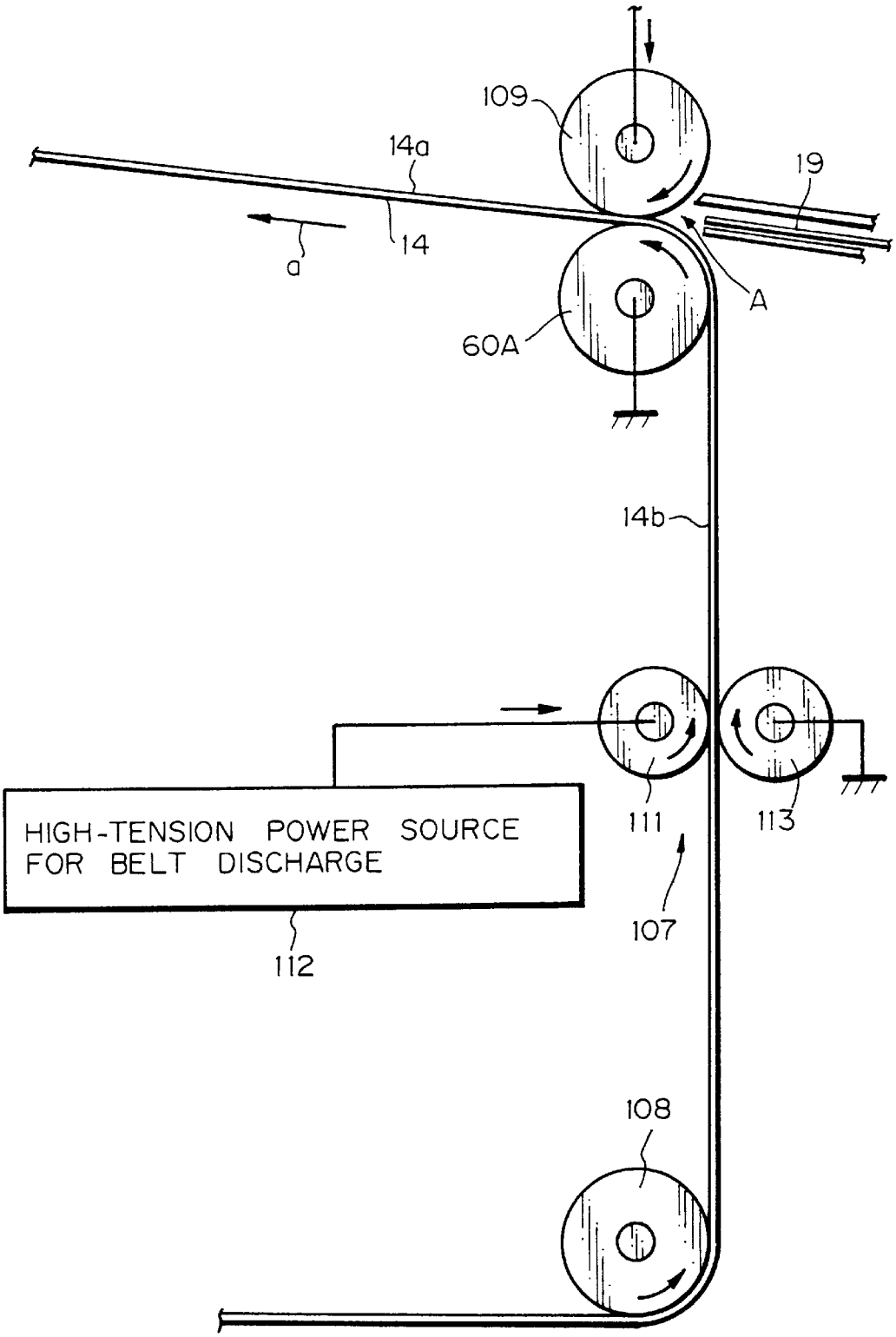
FIG. 9 shows charging means and belt discharging means included in the second embodiment.

The charging means 106 includes a charge roller or discharge member 109 having a medium resistance, and a high-tension power source 110. The charge roller 109 is freely rotatable at the position A where the paper 19 electrostatically adheres to the belt 14. As shown in FIG. 9, the charge roller 109 is held in contact with the outer surface 14*a* of the belt 14 and plays the role of a paper pressing member at the same time. The high-tension power source 110 is a DC power source for applying a charge bias to the charge roller 109. While the charge roller 109 is shown as being simply held in contact with the outer surface 14*a* of the belt 14, the roller 109 may be pressed against the surface 14*a* by a tension spring, not shown, leaf spring or similar biasing means, if desired.

The belt discharging means 107 is positioned between the position B and the charge roller 109, i.e., upstream of the position A in the direction of paper conveyance a. The belt discharging means 107 includes a discharge roller 111, a high tension power source 112, and an electrode roller 113 facing the discharge roller 111. The discharge roller 111 is journalled to the printer body, not shown, and held in contact with the inner surface 14*b* of the belt 14. The electrode roller 113 is journalled to a printer body portion, not shown, and held in contact with the outer surface 14*a* of the belt 14 facing the discharge roller 111. The high-tension power source 112 applies a discharge bias to the discharge roller 111 and implemented by a DC power source opposite in polarity to the high-tension power source 110. The power source 112 is driven at the same time as the power source 68 stated earlier.

The paper sensor S1 is an optical reflection type sensor and positioned above the portion of the belt 14 between the print section 11 and the discharger 67. When the paper 19 is brought to a position beneath the paper sensor S1, the sensor S1 outputs a signal.

Figure 10:
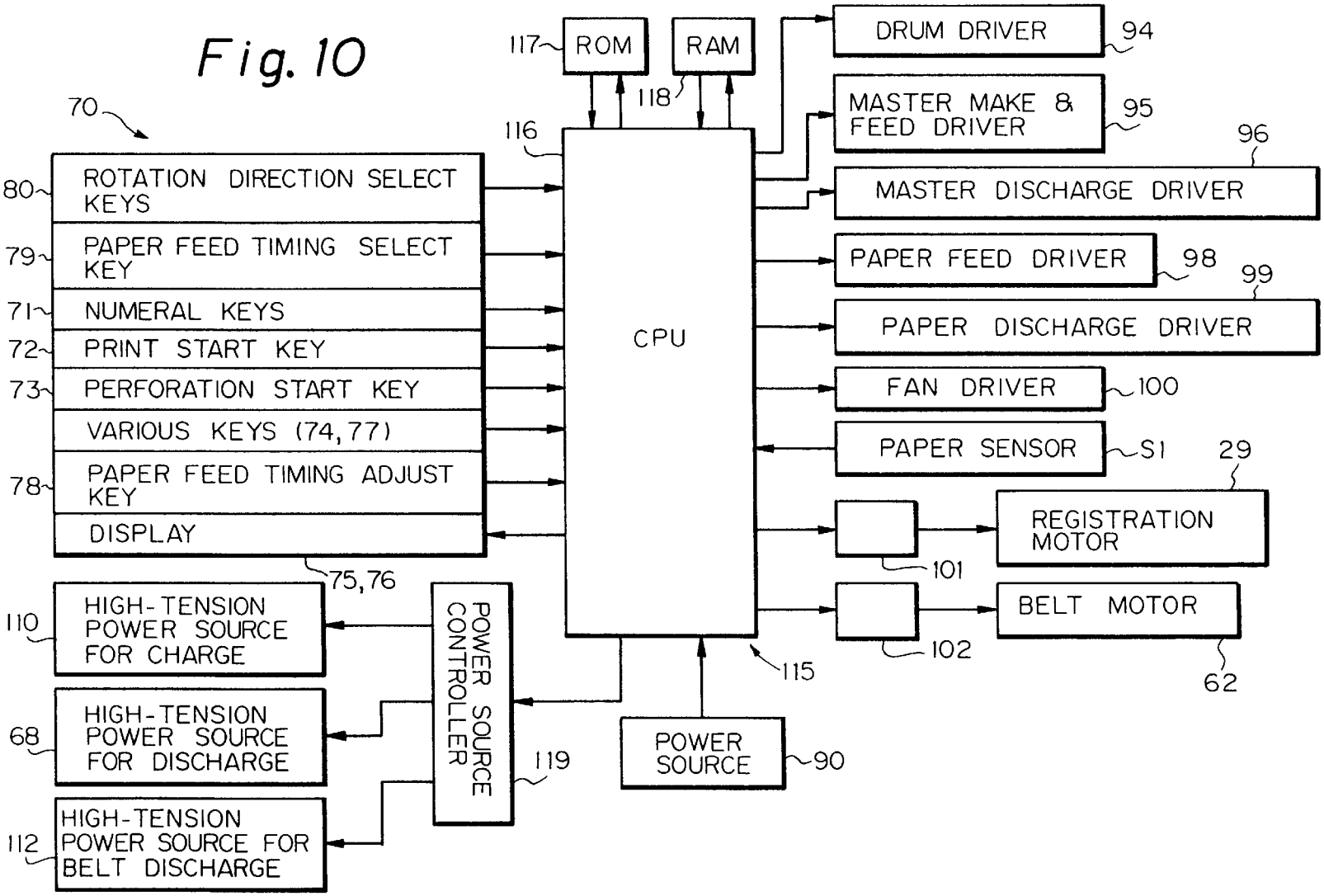
FIG. 10 is a block diagram schematically showing a control system included in the second embodiment.

As shown in FIG. 10, the high-tension power sources 110, 68 and 112 are electrically connected to a power source controller 119. The power source controller 119 is, in turn, electrically connected to a CPU 116 constituting control means 115.

The control means 115 is implemented by a conventional microcomputer including, in addition to the CPU 116, an I/O port, not shown, a ROM 117 and a RAM 118 which are interconnected by a signal bus not shown. The various keys and displays 75 and 76 arranged on the operation panel 70 are electrically connected to the CPU 116. The CPU 116 interchanges command signals and/or ON/OFF signals and data signals with the above keys and displays.

The CPU 116 is electrically connected to the drum driver 94 for reversibly rotating the ink drum 3, master make and feed driver 95 for driving the master making and feeding means 2, master discharge driver 96 for driving the master discharging means 18, paper feed driver 98 for driving the paper feed device except for the registration roller pair 53, paper discharge driver 99 for driving the paper discharge device 16 and fan driver 100 for driving the suction fan 85 so as to interchange command signals and/or ON/OFF signals and data signals therewith. In this configuration, the CPU 116 controls the operation of the entire printer including the start and stop of each device and driver as well as timings.

The registration motor 29 and belt motor 62 are connected to the CPU 116 via drivers 101 and 102, respectively. The CPU 116 is capable of controlling the drive conditions of the motors 29 and 62, i.e., the paper feed timing and the direction of rotation of the belt 14. The results of computation of the CPU 116 are temporarily written to the RAM 118 and read thereoutof, as needed.

The ROM 117 stores data necessary for the start and stop of each device and driver as well as timings beforehand. Specifically, there is stored in the ROM 117 a program for causing, when the perforation start key 73 is pressed, the master making, master discharging and trial printing procedure to occur and for causing, when the print start key 72 is pressed, the paper feeding, printing and paper discharging procedure to repeatedly occur a number of times corresponding to the number of printings input on the numeral keys 71. Specifically, when the paper 19 is fed from the tray 7 in response to the operation of the perforation start key 73 or the print start key 72, the high-tension power source 110 is driven to apply a charge bias to the belt 14 via the charge roller 109. At the same time, the high-tension power source 68 is driven to apply a discharge bias to the paper 19 and belt 14 via the discharger 67. Further, the high-tension power source 112 is driven to apply a belt discharge bias to the belt 14 via the discharge roller 111.

Assume that the paper sensor S1 does not output a signal on the elapse of a preselected period of time since the feed of the paper 19 from the tray 7, or that the paper sensor S1 does not stop outputting a signal. Then, the CPU 116 determines that a paper jam has occurred, and then interrupts the operation of the printer so as to give priority to a signal input from either one of the rotation direction select keys 80. Specifically, when the forward key 80*a* is pressed, the CPU 116 so controls the belt motor 62 as to rotate the belt 14 counterclockwise and so controls the drum driver 94 as to rotate the ink drum 3 clockwise. When the reverse key 80*b* is pressed, the CPU 116 causes the belt motor 62 to rotate the belt 14 clockwise and causes the drum driver 94 to rotate the ink drum 3 counterclockwise. An arrangement is made such that the control over the belt motor 62 and drum driver 94 via the above key 80 is valid only when the key 80 is being pressed.

A mechanism for moving the press roller 10 into and out of contact with the ink drum 3 may be provided independently, so that the roller 10 can be released from the drum 3 in the event of a paper jam.

The operation of the illustrative embodiment will be described hereinafter. Because the master making and feeding step and master discharging step have already been described specifically in relation to the first embodiment, the following description will concentrate on the feed of the paper 19, including one for trial printing, and the actual printing, separation conveyance and discharge effected with the paper 19, and belt discharge.

While the master feeding step ends when the master 5 is fully wrapped around the ink drum 3, the drum 3 is continuously rotated clockwise. At the same time, the belt motor 62 is driven to rotate the belt 14 counterclockwise at the same peripheral speed as the ink drum 3.

In the paper feed device 8, the pick-up roller 50 and upper feed roller 51*a* are rotated clockwise in synchronism with the ink drum 3. The feed roller pair 51 and stop plate 52 cooperate to feed only the top paper 19 from the tray 7 toward the registration roller pair 53 which is in a halt at that time. At the same time, the charge roller 109 charges the belt 14. Because the driven roller or electrode 60A faces the charge roller 109, a charge bias from the charge roller 109 is pulled toward the belt 14 by the electrode 60A. This allows the belt 14 to be stably charged. The registration roller pair 53 conveys the paper 19 toward the print section 11 at such a timing that the leading edge of the paper 19 meets the leading edge of the image area of the master 5 wrapped around the drum 3.

As shown in FIG. 9, when the paper 19 approaches the position A, it is nipped between the charge roller 109 and the outer surface 14*a* of the belt 14 while being electrostatically attracted by the surface 14*a* due to the charge deposited by the charge roller 109. As a result, the paper 19 is surely electrostatically adhered to the above surface 14*a* while being pressed against the surface 14*a*.

As the belt 14 conveys the paper 19 toward the print section 11, the area over which the paper 19 is electrostatically adhered to the belt 14 sequentially increases. Consequently, electrostatic adhesion between the paper 19 and the belt 14 sequentially is sequentially intensified as the paper 19 is conveyed toward the print section 11, stabilizing the position of the paper 19 on the belt 14.

At the above stage of operation, the press roller 10 is spaced from the outer periphery 3*a* of the ink drum 3, as indicated by the dash-and-dots line in FIG. 4. When the leading edge of the paper 19 approaches the print section 11, the cam 54 rotating in synchronism with the ink drum 3 cooperates with the cam follower 57 to raise the press roller 10 to the position indicated by the solid line in FIG. 4. As a result, the press roller 10 is pressed against the outer periphery 3*a* of the ink drum 3. The paper 19 is smoothly introduced into the print section 11 because it is sufficiently electrostatically adhered to the belt 14.

The press roller 10 is constantly pressed against the inner surface 14*b* of the belt 14 even when it is released from the ink drum 3. Therefore, when the belt 14 starts rotating, the press roller 10 also starts rotating in the same direction and at the same peripheral speed as the belt 14. It follows that despite the upward movement of the press roller 10, the peripheral speed of the press roller 10 or that of the belt 14 does not change. This successfully prevents the belt 14 from slackening or oscillating.

As shown in FIG. 5, on the entry of the paper 19 into the print section 11, the ink fed to the inner periphery 3*b* of the ink drum 3, i.e., the cylindrical porous thin sheet is passed through the pores of the above sheet due to the action of the press roller 10. The ink passed through the pores of the sheet to is spread by the mesh screen, then evenly spread by the porous support of the master 5, and then transferred to the paper 19 via the perforations formed in the film of the master 5. As a result, an image represented by the perforations of the master 5 is printed on the paper 19. The paper 19 with the image is further conveyed to the downstream side in the direction of paper conveyance a. At this instant, because the press roller 10 is pressed against the inner surface 14*b* of the belt 14, the belt 14 is free from slacking or oscillation and stably retains the paper 19 thereon. The portion of the belt 14 downstream of the print section 11 in the direction of paper conveyance a is inclined away from the print section 11 due to the positional relation between the press roller 10 and the drive roller 59. It follows that the paper 19 with the image is electrostatically firmly retained on the belt 14 and prevented from wrapping around the master 5 despite the absence of a separator around the ink drum 3. Consequently, the paper or printing 19 is free from marks ascribable to a separator.

When the leading edge of the printing 19 is brought to a position beneath the discharger 67, FIG. 8, by the belt 14, the discharger 67 discharges the belt 14 and printing 19 and thereby cancels electrostatic adhesion between the printing 19 and the belt 14. In this manner, the entire printing 19 and entire belt 14 moving below the discharger 67 are discharged.

The printing 19 discharged by the discharger 67 arrives at the position B where the belt 14 is curved due to the curvature of the drive roller 59. As a result, at the position B, the printing 19 is separated from the belt 14 due to its own elasticity and the curvature of the belt 14. The leading edge of the printing 19 separated from the belt 14 is guided by the separator 86 to the belt 84 located downstream of the belt 14 in the direction of paper conveyance a.

The printing 19 transferred from the belt 14 to the belt 84 is conveyed by the belt 84, which is rotating counterclockwise, while being retained on the belt 84 by the sucking force of the fan 85 and friction acting between the printing 19 and the belt 84. The belt 84 is caused to move at a higher peripheral speed than the outer periphery 3*a* of the ink drum 3, i.e., the belt 14. Therefore, when the trailing edge of the printing 19 moves away from the print section 11, the printing 19 is accelerated to the peripheral speed of the belt 84. The printing 19 is conveyed to the jump platform 87 by the belt 84 while being retained thereon by the suction fan 85. Then, the printing 19 is separated from the belt 84 by the jump platform 87 and caused to jump into the tray 17. As a result, the printing 19 hits against an end plate included in the tray 17 and then drops to be stacked on the bottom of the tray 17.

After the separation of the paper 19, the belt 14 moved away from the position B is continuously moved toward the belt discharging means 107. In the belt discharging means 107, the high-tension power source 112 applies a belt discharge bias opposite in polarity to the charge bias to the belt 14 via the discharge roller 111, dissipating the charge remaining on the belt 14. Because the electrode roller 113 faces the discharge roller 111 with the intermediary of the belt 14, the belt discharge bias is stably applied to the belt 14 and insures the stable discharge of the belt 14. Therefore, even when the charge on the belt 14 moved away from the discharger 67 and from which the paper 19 has been separated is irregular due to the irregular thickness of the paper 19 or that of the belt 14, the charge can be fully dissipated. This allows the belt 14 to be desirably charged by the charge roller 109 later, i.e., obviates a decrease in the adhesive force between the paper 19 and the belt 14 and ascribable to short charge to thereby insure the desirable conveyance of the paper 19 and the desirable entry of the same into the print section 11.

When the paper sensor S1 does not output a signal on the elapse of a preselected period of time necessary for the paper 19 to be fed and then discharged, or when the sensor St does not stop outputting a signal, the CPU 116 determines that a paper jam has occurred, interrupts the operation of the printer, and displays a paper jam on the display 76.

The above jam display urges the operator to open a casing, not shown, included in the printer to see a position where the jam has occurred. If the paper 19 has jammed the path between the print section 11 and the discharger 67, then the operator presses the forward key 80*a*. In response, the belt 14 is caused to rotate counterclockwise, conveying the jamming paper 19 toward the paper discharge device 16. If the paper 19 has jammed the path between the print section 11 and the charge roller 109, then the operator presses the reverse key 80*b*. In response, the belt 14 is caused to rotate clockwise, conveying the paper 19 toward the paper feed device 8.

As stated above, by operating either the forward key 80*a* or the reverse key 80*b*, it is possible to switch the direction of rotation of the belt 14. Therefore, even when the paper 19 jams the transport path, the operator can remove the paper 19 rapidly. This not only promotes easy operation of the printer, but also reduces the down time and therefore the printing time of the printer.

In the first and second embodiments, the high-tension power sources 68 and 112 are provided independently of each other. Alternatively, the two power sources 68 and 112 may be implemented as a common power source because both of them are opposite in polarity to the high-tension power source 110. The common power source will reduce the cost and space requirements and will thereby miniaturize the entire printer.

3rd Embodiment

Figure 11:
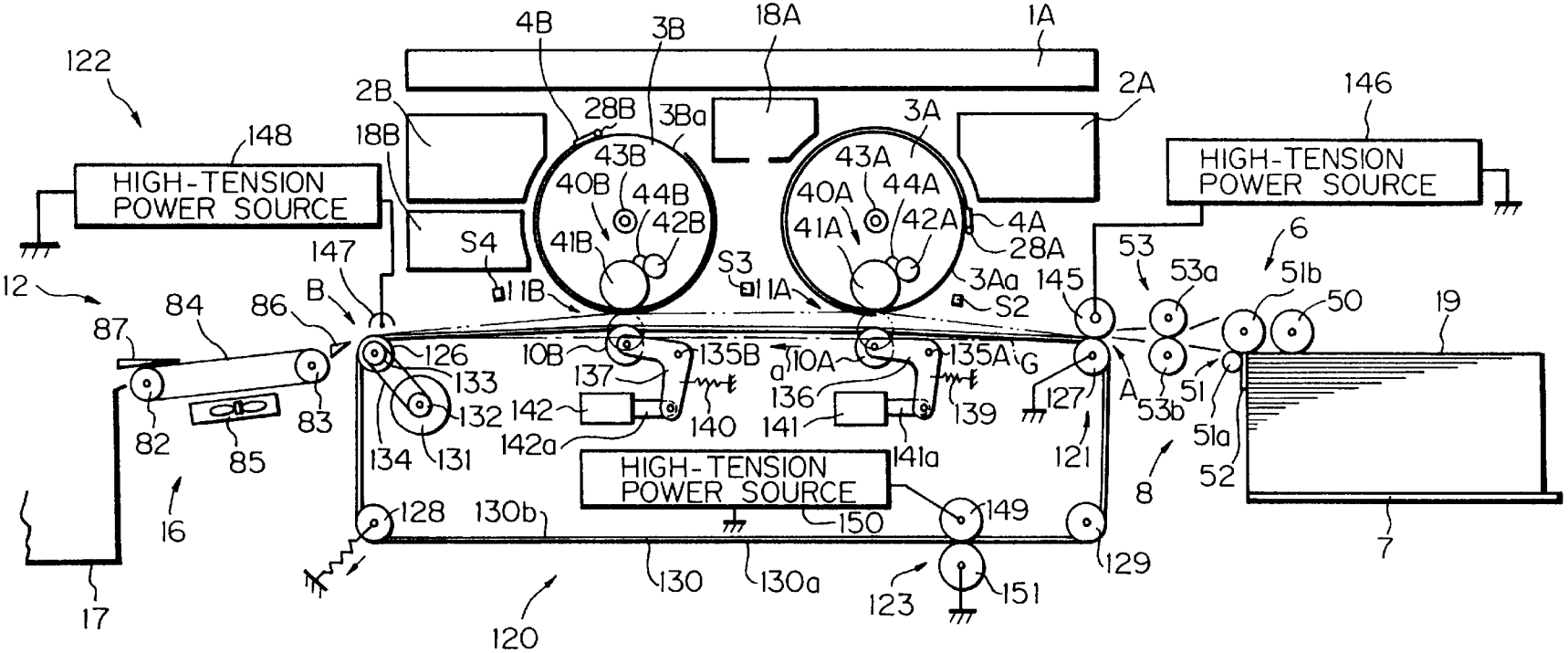
FIG. 11 shows a third embodiment of the stencil printer in accordance with the present invention.

FIG. 11 shows a third embodiment of the present invention implemented as a double drum type stencil printer. As shown, the stencil printer includes a belt conveyor 120 for conveying the paper 19, two ink drums 3A and 3B arranged side by side from the upstream side to the downstream side in the direction of paper conveyance a, document reading means 1A, two master making and feeding means 2A and 2B, two master discharging means 18A and 18B, the paper feed device 8, the paper discharge device 16, two press rollers 10A and 10B, charging means 121, discharging means 122, and belt discharging means 123. With these structural elements, the stencil printer is capable of effecting multicolor printing (bicolor printing in the illustrative embodiment), as desired.

The document reading means 1A has, in addition to the structural elements shown in FIG. 2, a construction having various functions for color separation and a filter unit including a plurality of replaceable color filters. The master making and feeding means 2A and 2B and master discharging means 18A and 18B are arranged around the ink drums 3A and 3B. The master discharging means 18A and 18B respectively remove used masters from the outer peripheries 3A*a* and 3B*a* of the ink drums 3A and 3B. The master making and feeding means 2A and 2B each makes a master 5A or 5B in accordance with an image signal output from the document reading means 1A and wraps the master 5A or 5B around the above periphery 3A*a* or 3B*a*, respectively. Therefore, the masters 5A and 5B each is representative of an image component of particular color.

Ink feed devices 40A and 40B are arranged in the ink drums 3A and 3B, respectively. The ink feed devices 40A and 40B respectively feed magenta ink (first color) and black ink (second color) to the ink drums 3A and 3B.

The belt conveyor 120 conveys the paper 19 fed from the registration roller pair 53 at the preselected timing, while electrostatically retaining it thereon. A belt 130 is passed over a drive roller 126, a driven roller 127, a tension roller 128 and a driven roller 129 under tension such that it extends through spaced print sections 11A and 11B. The drive roller 126 is positioned closer to the paper discharge section 12 than the print section 11B where the ink drum 3B and press roller 10B face each other. The driven roller 127 is positioned in the vicinity of the registration roller pair 53 closer to the paper seed section 6 than the print section 11A where the ink drum 3A and press roller 10A face each other.

The tension roller 128 and driven roller 129 each may be a drum-like roller member having a preselected diameter. The tension roller 128 and driven roller 129 are positioned below the drive roller 126 and driven roller 127, respectively. The drive roller 126 and driven roller 129 diagonally face each other, and so do the tension roller 128 and driven roller 127. The belt 130 is therefore runs along a substantially rectangular path.

The drive roller 126 and driven roller 127 are positioned such that horizontal lines tangential to the rollers 126 and 127, respectively, coincide with each other on the common tangential line G. The driven roller 127 has a medium resistance and formed of natural rubber in which aluminum and a conductive filler are dispersed. The driven roller 127 constitutes an electrode facing the charging means 121.

The belt conveyor 130 is driven by a belt motor 131, pulleys 132 and 133 and a belt 134 passed over the pulleys 131–133 such that the belt 130 moves at the same peripheral speed as the outer peripheries 3A*a* and 3B*a* of the ink drums 3A and 3B. The belt motor 131 is a reversible motor. In the belt conveyor 120, the counterclockwise rotation and clockwise rotation of the belt 130 are assumed to be forward rotation and reverse rotation, respectively. The belt 130 is a seamless belt formed of an insulator and can be easily charged and discharged by the charging means 121 and discharging means 122, respectively.

The press rollers 10A and 10B are respectively movable into and out of contact with the outer peripheries 3A*a* and 3B*a* of the ink drums 3A and 3B at positions where they face ink roller 41A and 41B, respectively. The press rollers 10A and 10B respectively press the paper 19 against the ink drums 3A and 3B via the belt 130 extending between the paper feed section 6 and the paper discharge section 12 via the print sections 11A and 11B. The press rollers 10A and 10B protrude above the common tangential line G of the drive roller 126 and driven roller 127.

Figure 12:
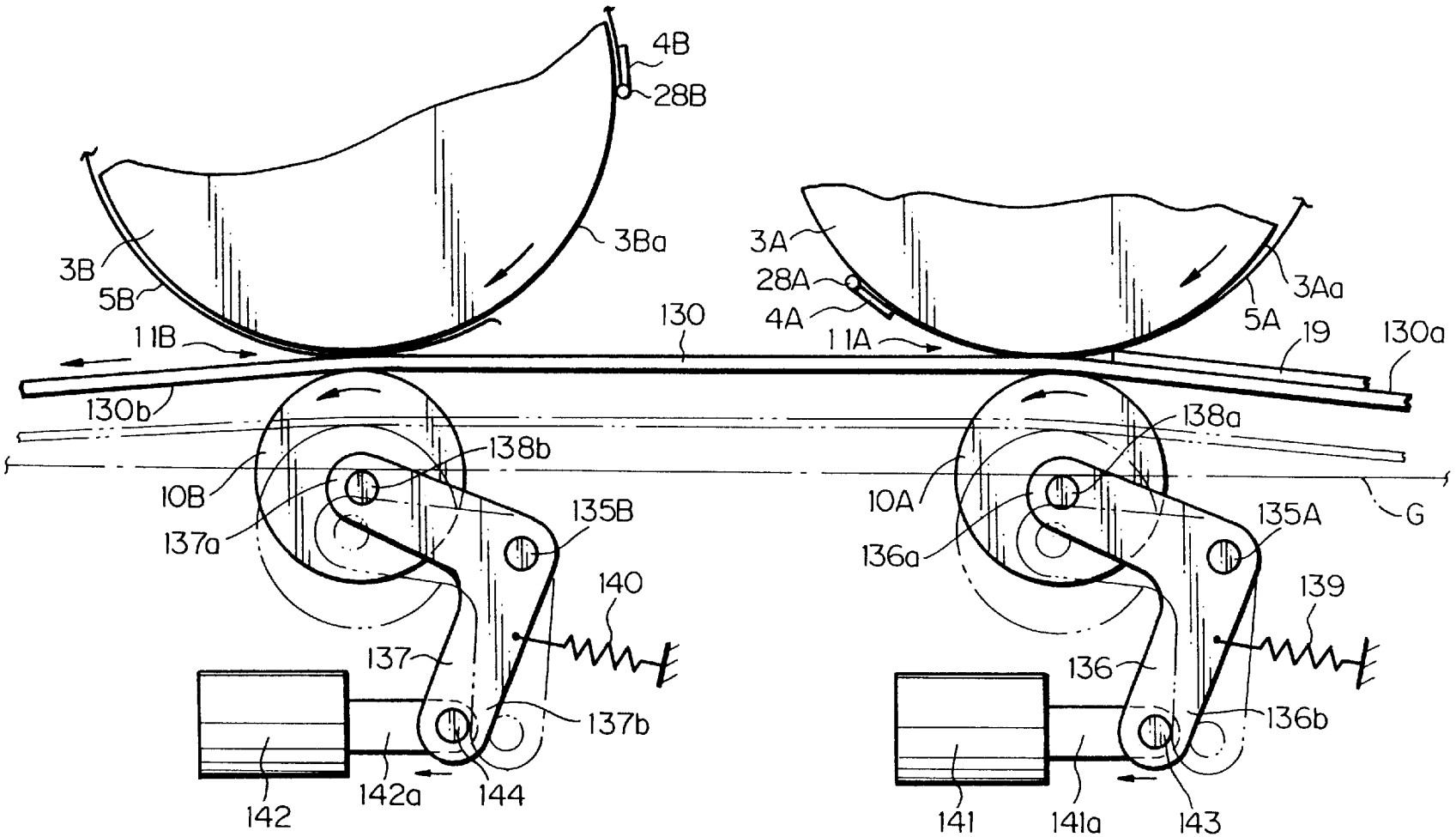
FIG. 12 shows a press roller moving mechanism included in the third embodiment together with the operation of the mechanism and a paper about to enter a print section.

Specifically, as shown in FIG. 12, generally L-shaped press roller arms 136 and 137 are rotatable about shafts 135A and 135B, respectively. The press rollers 10A and 10B are respectively rotatably mounted on one end 136*a* of the press roller arm 136 and one end 137*a* of the press roller arm 137 via shafts 138*a* and 138*b* and movable into and out of contact with the outer peripheries 3A*a* and 3B*a* of the ink drums 3A and 3B. Tension springs 139 and 140 are respectively anchored to the other end portions 136*b* and 137*b* of the arms 136 and 137 so as to constantly bias the press rollers 10A and 10B away from the drums 3A and 3B.

Electromagnetic solenoids 141 and 142 include plungers 141 a and 142*a*, respectively. The plungers 141 a and 142*a* are respectively connected to the ends 136*b* and 237*b* of the press roller arms 136 and 137 by pins 143 and 144. Tension springs 139 and 140 respectively constantly bias the plungers 141 and 142 away from the solenoid bodies. On receiving a drive signal, the solenoids 141 and 142 each pulls its plunger 141*a* or 142*a* against the action of the tension spring 139 or 140.

The solenoids 141 and 142 are driven in synchronism with the feed of the paper 19 from the registration roller pair 53 and the rotation of the ink drums 3A and 3B. When the sheet 19 is not fed from the registration roller pair 53, the solenoids 141 and 142 both remain deenergized, maintaining the press rollers 10A and 10B spaced from the drums 3A and 3B, respectively.

As shown in FIG. 12, in the above configuration, the press rollers 10A and 10B are constantly pressed against the inner surface 130*b* of the belt 130 at the print sections 11A and 11B, respectively, causing the belt 130 to protrude upward toward the outer peripheries 3A*a* and 3B*a* of the ink drums 3A and 3B. The outer surface 130*a* of the belt 130 facing the print sections 11A and 11B forms a paper transport path.

Figure 13:
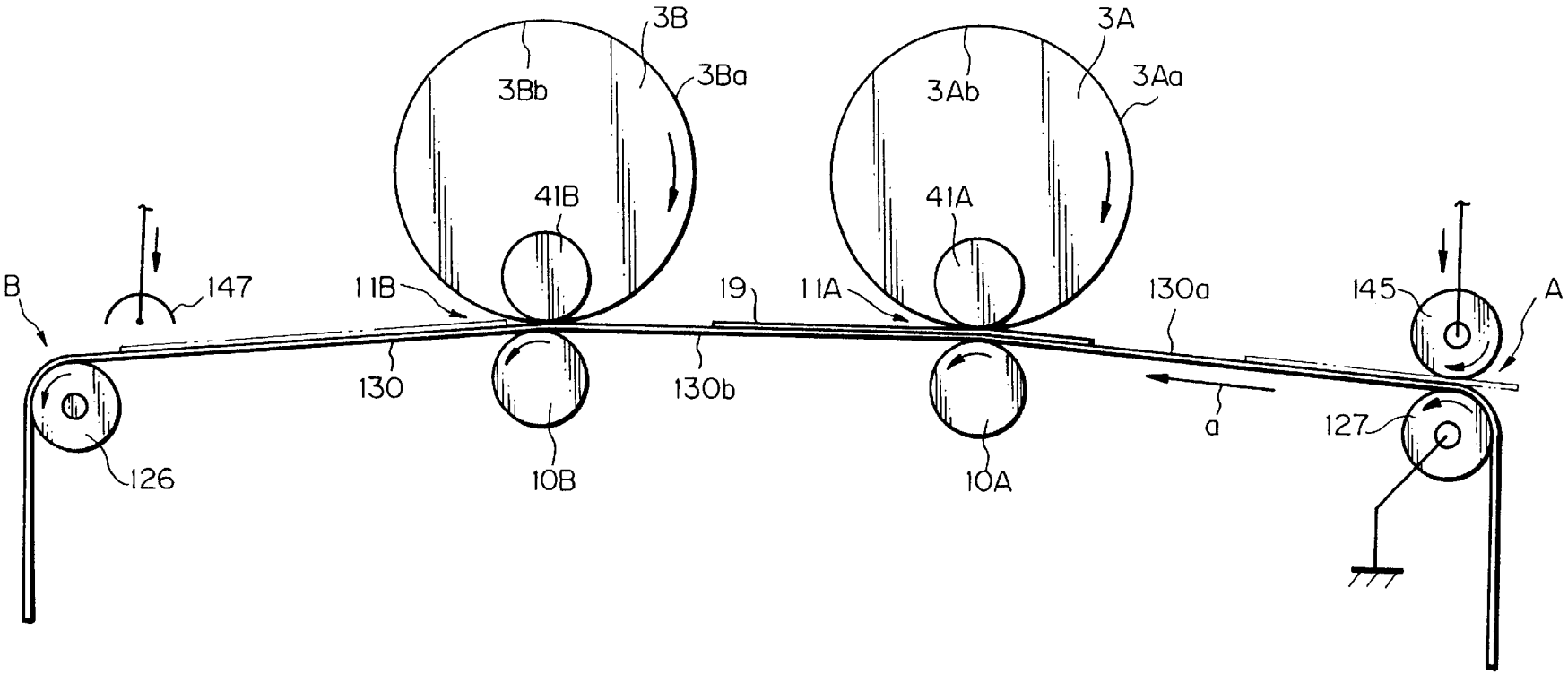
FIG. 13 demonstrates the movement of a paper being conveyed by a belt included in the third embodiment.

The charging means 121 includes a charge roller 145 of medium resistance and a high-tension power source 146. The charge roller 145 is rotatable at the position A and, as shown in FIG. 13, held in contact with the outer periphery 130*a* of the belt 130. The charge roller 145 plays the role of a paper pressing member at the same time. The high-tension power source 146 is a DC power source for applying a charge bias to the charge roller 145. While the charge roller 145 is shown as being simply held in contact with the outer surface 130*a* of the belt 130, the roller 145 may be pressed against the surface 130*a* by a tension spring, not shown, leaf spring or similar biasing means, if desired. Alternatively, the charge roller 145 may be slightly spaced from the surface 130*a* of the belt 130.

As shown in FIG. 11, the discharging means 122 includes a discharger 147 and a high-tension power source 148. The discharger 147 is located at a position adjoining the circumferential surface of the drive roller 126 and upstream of the position B in the direction of paper conveyance a. The discharger 147 is also implemented by a non-contact type corotron discharger effecting corona discharge. The high-tension power source 148 is an AC power source for applying a discharge bias to the discharger 147.

The belt discharging means 123 includes a discharge roller 149, a high-tension power source 150, and an electrode roller 151 facing the discharge roller 149. The belt discharging means 123 is positioned between the discharger 147 and the charge roller 145, i.e., upstream of the position A in the direction of paper conveyance a. The discharge roller 149 is journalled to the printer body, not shown, and held in sliding contact with the inner surface 130*b* of the belt 130. The electrode roller 151 is also journalled to the printer body and held in contact with the outer surface 130*a* of the belt 130. The high-tension power source 150 applies a belt discharge bias to the discharge roller 149 and is implemented as a DC power source opposite in polarity to the high-tension power source 146 in the illustrative embodiment.

Figure 14:
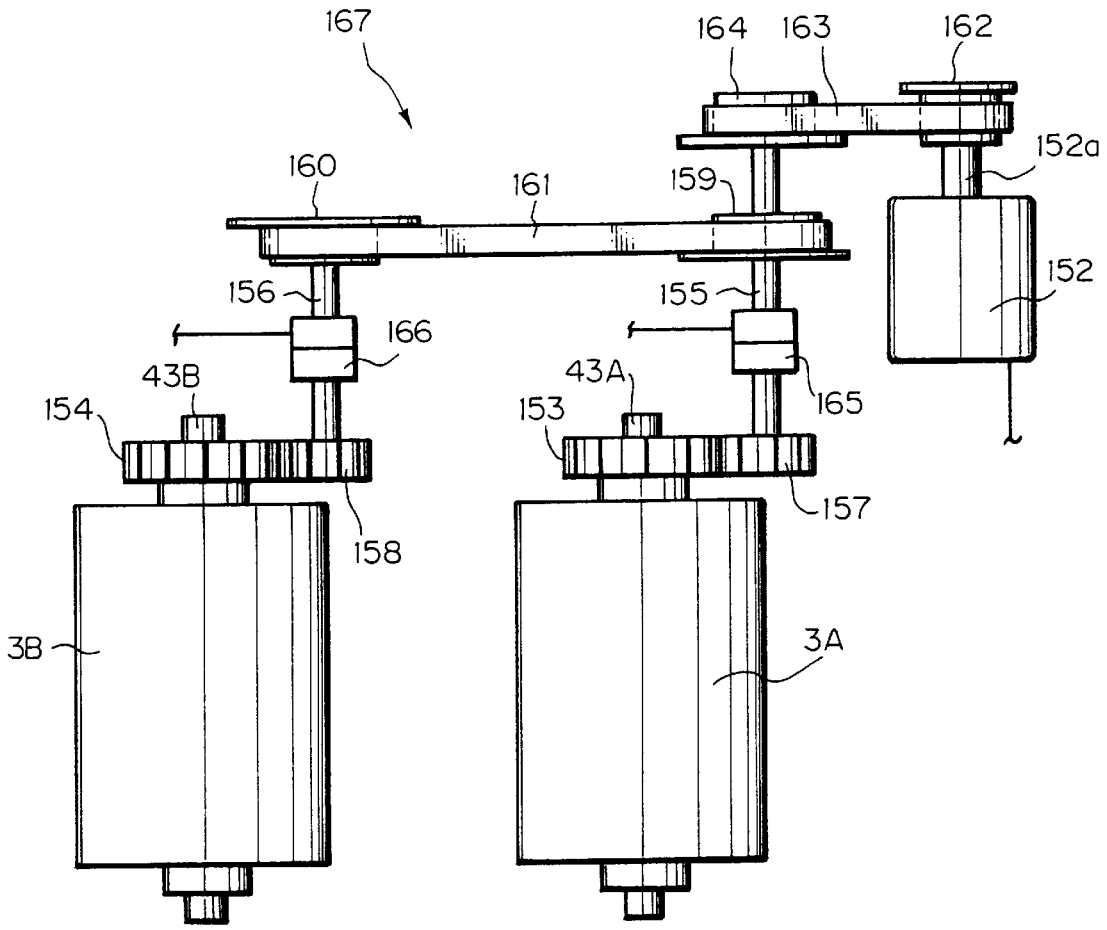
FIG. 14 shows a drum drive arrangement also included in the third embodiment.

FIG. 14 shows a drum drive section 167 for driving the ink drums 3A and 3B. As shown, the ink drums 3A and 3B are driven by a single drum motor 152. Drive gears 153 and 154 are respectively affixed to one side of the ink drum 3A and one side of the ink drum 3B. Gears 157 and 158 respectively mounted on one end of a shaft 155 and one end of a shaft 156 are held in mesh with the drive gears 153 and 154, respectively. Pulleys 159 and 160 are respectively affixed to the other end of the shaft 155 and the other end of the shaft 156. A belt 161 is passed over the pulleys 159 and 160. The pulleys 159 and 160 have the same diameter as each other and respectively rotate the ink drums 3A and 3B at the same peripheral speed.

The shafts 155 and 156 each is divided at its intermediate portion. Electromagnetic clutches 165 and 166 respectively intervene between the divided portions of the shaft 155 and between the divided portions of the shafts 156. Usually, the clutches 165 and 166 are uncoupled to respectively maintain the shafts 155 and 166 in their disconnected conditions. In response to a drive signal, the clutches 165 and 166 each is coupled to connect the associated shaft 155 or 156 to thereby transfer a torque to the ink drum 3A or 3B.

As shown in FIG. 11, paper sensors S2, S3 and S4 responsive to the paper 19 are respectively positioned between the charge roller 145 and the print section 11A, between the ink drums 3A and 3B, and between the print section 11B and the discharger 147. The paper sensors S2–S4 are disposed above the belt 130, and each is implemented by an optical reflection type sensor. The paper sensors S2–S4 each outputs a signal when the paper 19 is brought to a position below the sensor.

As shown in FIG. 15, the high-tension power sources 146, 148 and 150 for charging, discharging (paper separation) and belt discharging, respectively, are electrically connected to a power source controller 169. The power source controller 169 is electrically connected to a CPU 171 constituting control means 170. The solenoids 141 and 142, clutches 165 and 166 and paper sensors S2–S4 are also electrically connected to the CPU 171.

The control means 170 is implemented by a conventional microcomputer including, in addition to the CPU 171 connected to the power source 90, an I/O port, not shown, a ROM 172 and a RAM 173 which are interconnected by a signal bus not shown.

Figure 16:
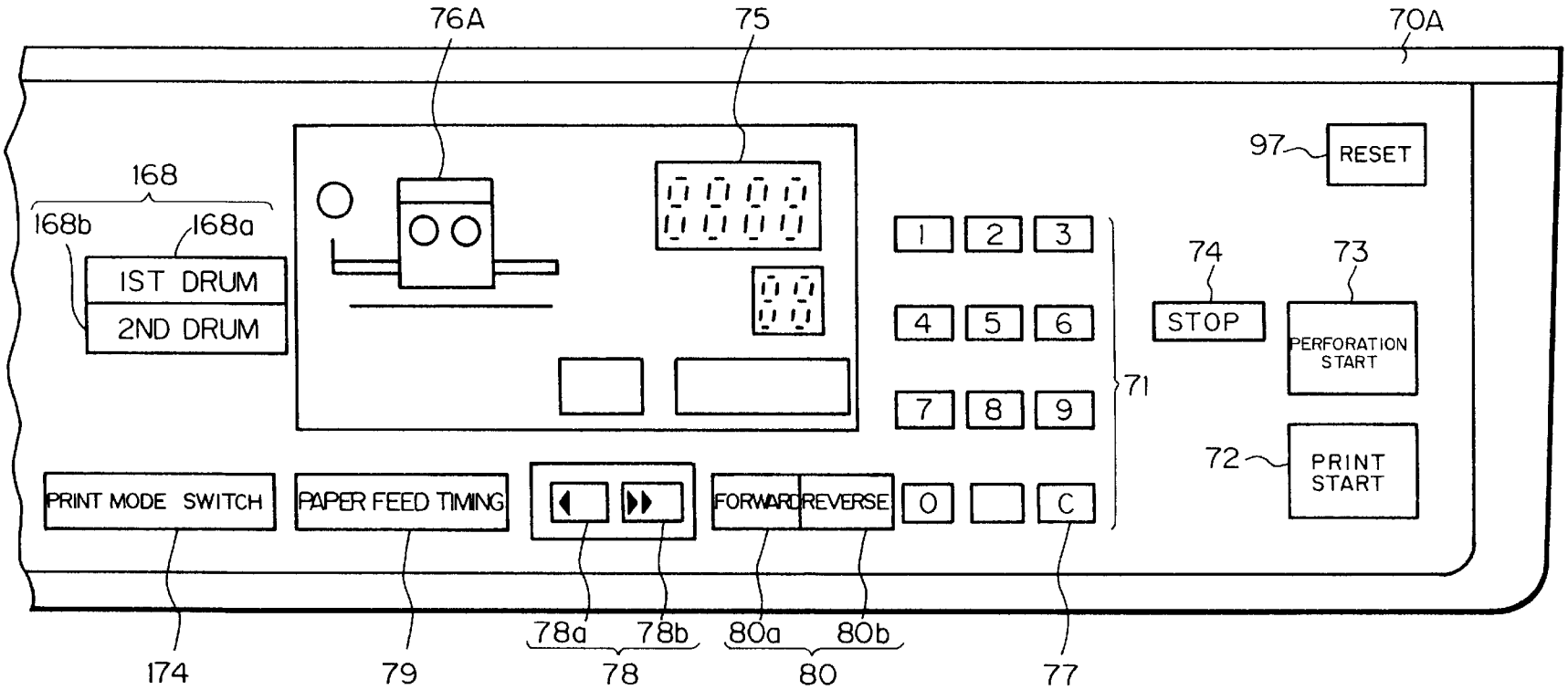
FIG. 16 is a fragmentary plan view showing an operation panel included in the third embodiment.

As shown in FIG. 16, various keys and displays are arranged on an operation panel 70A and include the previously stated numeral keys 71, print start key 72, perforation start key 73, stop key 74, display 75, clear key 77, paper feed timing select key 79, paper feed timing adjust keys 78, i.e., down key 78*a* and up key 78*b*, rotation direction select keys or selecting means 80, i.e., forward key 80*a* and reverse key

80*b*. In the illustrative embodiment, a display 76A for displaying the location and content of a paper jam or similar error, a reset key 97 for causing a printing operation to start all over again, drum select keys 168 for selecting either one of the ink drums 3A and 3B, and a print mode switch key 174 are additionally arranged on the operation panel 70A. The drum select keys 168 are implemented as a first drum select key 168*a* and a second drum select key 168*b* assigned to the ink drums 3A and 3B, respectively. The CPU 171 is electrically connected to the above keys and displays and interchange command signals and/or ON/OFF signals and data signals therewith.

As shown in FIG. 15, the CPU 171 is electrically connected to the drum drive section 167 for reversibly rotating the ink drums 3A and 3B, the master make and feed driver 95 for driving the master making and feeding means 2A and 2B, the master discharge driver 96 for driving the master discharging means 18A and 18B, the paper feed driver 98 for driving the paper feed device 8 except for the registration roller pair 53, paper discharge driver 99 for driving the paper discharge device 16 and the fan driver 100 for driving the suction fan 85 so as to interchange command signals and/or ON/OFF signals and data signals therewith. In this configuration, the CPU 171 controls the operation of the entire printer including the start and stop of each device and driver as well as timings.

The registration motor 29 and belt motor 131 are connected to the CPU 171 via the drivers 101 and 102, respectively. The CPU 171 is capable of controlling the drive conditions of the motors 29 and 131, i.e., the paper feed timing and the direction of rotation of the belt 130. The results of computation of the CPU 171 are temporarily written to the RAM 173 and read thereoutof, as needed.

The ROM 172 stores data necessary for the start and stop of each device and driver as well as timings beforehand. In the illustrative embodiment, an automatic program and a manual program are stored in the ROM 172. The automatic program causes, when the perforation start key 73 is pressed, the master making, master discharging and trial printing procedure to occur or causes, when the print start key 72 is pressed, the paper feeding, printing and paper discharging procedure to repeatedly occur a number of times corresponding to the number of printings input on the numeral keys 71.

In any one of the above programs, the paper 19 is fed from the tray 7 when the perforation start key 73 or the print start key 72 is pressed. Then, the high-tension power source 146 is driven to apply a charge bias to the belt 130 via the charge roller 145. When the paper 19 sequentially moved away from the print sections 11A and 11B approaches the position B, the high-tension power source 148 is driven to apply a discharge bias to the paper 19 and belt 130 via the discharger 147. At the same time, the high-tension power source 150 is driven to apply a discharge bias to the belt 130 via the discharge roller 149. When any one of the paper sensors S2–S4 does not output a signal during printing or when it continuously outputs a signal over more than a preselected period of time, the CPU 171 determines that a paper jam has occurred, and interrupts the operation of the printer so as to give priority to a signal input from either one of the rotation direction select keys 80. Specifically, when the forward key 80*a* is pressed, the CPU 171 so controls the belt motor 131 as to move the belt 130 counterclockwise. When the reverse key 80*b* is pressed, the CPU 171 so controls the belt motor 131 to move the belt 130 clockwise. At this instant, the CPU 171 should preferably control the solenoids 141 and 142 in order to release the press rollers 10A and 10B from the ink drums 3A and 3B, respectively. Such control effected over the belt motor 131 and drum driver 167 via the rotation direction select key 80*a* or 80*b* is valid only when the key 80*a* or 80*b* is being pressed.

When the print mode switch key 174 is pressed, the CPU 171 gives priority to the manual program. In the manual program, when the first drum select key 168*a* is pressed, the CPU 171 adequately drives the solenoid 141 and clutch 165 in order to effect printing only with the ink drum 3A, while deenergizing the solenoid 142 and clutch 166. When the second drum select key 168*b* is pressed, the CPU 171 adequately drives the solenoid 142 and clutch 166 in order to effect printing only with the ink drum 3B, while deenergizing the solenoid 141 and clutch 165.

The operation of the illustrative embodiment will be described hereinafter. Because the master making and feeding step and master discharging step have already been described specifically in relation to the first embodiment, the following description will concentrate on the feed of the paper 19, including one for trial printing, and the actual printing, separation conveyance and discharge effected with the paper 19, and belt discharge.

The printer is usually set to operate with the automatic program. While the master feeding step ends when the masters 5A and 5B are respectively fully wrapped around the ink drums 3A and 3B, the ink drums 3A and 3B are continuously rotated clockwise. At the same time, the belt motor 131 is driven to rotate the belt 130 counterclockwise at the same peripheral speed as the ink drums 3A and 3B.

In the paper feed device 8, the pick-up roller 50 and upper feed roller 51*a* are rotated clockwise in synchronism with the ink drums 3A and 3B. The feed roller pair 51 and stop plate 52 cooperate to feed only the top paper 19 from the tray 7 toward the registration roller pair 53 which is in a halt at that time. At the same time, the charge roller 145 charges the belt 130. Because the driven roller or electrode 127 faces the charge roller 145, a charge bias from the charge roller 145 is pulled toward the belt 130 by the electrode 127. This allows the belt 130 to be stably charged. The registration roller pair 53 conveys the paper 19 toward the print section 11A at such a timing that the leading edge of the paper 19 meets the leading edge of the image area of the master 5A wrapped around the drum 3A.

As shown in FIG. 13, when the paper 19 approaches the previously stated position A, it is nipped between the charge roller 145 and the outer surface 130*a* of the belt 130 while being electrostatically attracted by the surface 130*a* due to the charge deposited by the charge roller 145. As a result, the paper 19 is surely electrostatically adhered to the above surface 130*a* while being pressed against the surface 130*a*.

As the belt 130 conveys the paper 19 toward the print section 11A, the area over which the paper 19 is electrostatically adhered to the belt 130 sequentially increases. Consequently, electrostatic adhesion between the paper 19 and the belt 130 is sequentially intensified as the paper 19 is conveyed toward the print section 11A, stabilizing the position of the paper 19 on the belt 130.

At the above stage of operation, the press rollers 10A and 10B are respectively spaced from the outer peripheries 3A*a* and 3B*a* of the ink drums 3A and 3B, as indicated by dash-and-dots lines in FIG. 12. When the leading edge of the paper 19 approaches the print section 11A, the solenoids 141 and 142 are energized to raise the press rollers 10A and 10B, respectively, toward the outer peripheries 3A*a* and 3B*a* of the ink drums 3A and 3B, as indicated by solid lines in FIG. 12. As a result, the portion of the belt 130 between the position A and the print section 11A is inclined upward in the direction of paper conveyance a. The paper 19 is smoothly introduced into the print section 11A because of the above inclination of the belt 130 and the sufficient electric adhesion of the paper 19 to the belt 130. On the other hand, the portion of the belt 130 between the print section 1 B and the position B is inclined downward in the direction of paper conveyance a. The portion of the belt 130 between the print sections 11A and 11B is horizontal.

The press rollers 10A and 10B are constantly pressed against the inner surface 130*b* of the belt 130 even when they are released from the ink drums 3A and 3B, respectively. Therefore, when the belt 130 starts rotating, the press rollers 10A and 10B also start rotating in the same direction and at the same peripheral speed as the belt 130. It follows that despite the movement of the press rollers 10A and 10B, the peripheral speeds of the press rollers 10A and 10B or the peripheral speed of the belt 130 does not change. This successfully prevents the belt 130 from slackening or oscillating.

As shown in FIG. 13, on the entry of the paper 19 into the print section 11A, the ink fed to the inner periphery 3A*b* of the ink drum 3A, i.e., the cylindrical porous thin sheet is passed through the pores of the above sheet due to the action of the press roller 10A. The ink passed through the pores of the sheet is spread by the mesh screen, then evenly spread by the porous support of the master 5A, and then transferred to the paper 19 via the perforations formed in the film of the master 5A. As a result, an image represented by the perforations of the master 5A is printed on the paper 19 in the first color. The paper 19 with the image is sufficiently electrostatically adhered to the belt 130. This, coupled with the fact that the belt 130 is free from slackening or oscillation, allows the paper 19 to be desirably separated from the outer periphery 3A*a* of the ink drum 3A without resorting to a separator around the drum 3A. The paper 19 is further conveyed toward the next print section 11B in such a desirable condition. Consequently, the paper or printing 19 is free from marks ascribable to a separator and from a delay relative to the ink drum 3B.

The paper 19 moved away from the print section 11A is caused to adhere to the belt 130 over a broader area and therefore more intensely, while being conveyed toward the next print section 11B. This frees the paper 19 from a delay ascribable to short electrostatic adhesion and insures the smooth entry of the paper into the print section 11B, thereby minimizing the dislocation of the print position at the ink drum 3B and the occurrence of an overlapping image.

On the entry of the paper 19 into the print section 11B, the ink fed to the inner periphery 3B*b* of the ink drum 3B, i.e., the cylindrical porous thin sheet is passed through the pores of the above sheet due to the action of the press roller 10B. The ink passed through the pores of the sheet is spread by the mesh screen, then evenly spread by the porous support of the master 5B, and then transferred to the paper 19 via the perforations formed in the film of the master 5B. As a result, an image represented by the perforations of the master 5B is printed on the paper 19 in the second color over the image of the first color. Because the delay of the paper 19 relative to the print drum 3B is extremely small at the print section 11B, the resulting bicolor image is free from overlapping or dislocation.

The paper 19 with the bicolor image is further conveyed by the belt 130 from the print section 11B to the downstream side in the direction of paper conveyance a. At this instant, the contact area between the paper 19 and the belt 130 further increases. This, coupled with the fact that the belt 130 moved away from the print section 11B is inclined downward away from the print section 11B, allows the paper 19 coming out of the print section 11B to be surely separated from the outer periphery 3B*a* of the ink drum 3B without resorting to a separator around the drum 3B. The paper or bicolor printing 19 is therefore free from marks ascribable to a separator.

When the leading edge of the bicolor printing 19 is brought to a position beneath the discharger 147 by the rotation of the belt 130, the discharger 147 discharges the belt 130 and printing 19 and thereby cancels the electrostatic adhesion. In this manner, the entire paper 19 and entire belt 130 moving below the discharger 147 are discharged.

The printing 19 discharged by the discharger 147 arrives at the position B where the belt 130 is curved due to the curvature of the drive roller 126. As a result, at the position B, the printing 19 is separated from the belt 130 due to its own elasticity and the curvature of the belt 130. The leading edge of the printing 19 separated from the belt 130 is guided by the separator 86, FIG. 1, to the belt 84 located downstream of the belt 130 in the direction of paper conveyance a.

The printing 19 transferred from the belt 130 to the belt 84 is conveyed by the belt 84, which is rotating counterclockwise, while being retained on the belt 84 by the sucking force of the fan 85 and friction acting between the printing 19 and the belt 84. The belt 84 is caused to move at a higher peripheral speed than the outer peripheries 3A*a* and 3B*a* of the drums 3A and 3B, i.e., the belt 130. Therefore, when the trailing edge of the printing 19 moves away from the print section 11B, the printing 19 is accelerated to the peripheral speed of the belt 84. The printing 19 is conveyed to the jump platform 87 by the belt 84 while being retained thereon by the suction fan 85. Then, the printing 19 is separated from the belt 84 by the jump platform 87 and caused to jump into the tray 17. As a result, the printing 19 hits against an end plate included in the tray 17 and then drops to be stacked on the bottom of the tray 17.

After the separation of the paper 19, the belt 130 moved away from the position B is continuously moved toward the discharging means 123. In the discharging means 123, the high-tension power source 150 applies a belt discharge bias opposite in polarity to the charge bias to the belt 130 via the discharge roller 149, dissipating the charge remaining on the belt 130. Because the electrode roller 151 faces the discharge roller 149 with the intermediary of the belt 130, the belt discharge bias is stably applied to the belt 130 and insures the stable discharge of the belt 130. Therefore, even when the charge on the belt 130 moved away from the discharger 147 and from which the paper 19 has been separated is irregular due to the irregular thickness of the paper 19 or that of the belt 130, the charge can be fully dissipated. This allows the belt 130 to be desirably charged by the charge roller 145 later, i.e., obviates a decrease in the electrostatic adhesive force between the paper 19 and the belt 130 and ascribable to short charge to thereby insure the desirable conveyance of the paper 19 and the desirable entry of the same into the print sections 11A and 11B.

In the illustrative embodiment, the belt 130 is formed of an insulator, and the high-tension power source 148 for discharge is an AC power source. In this case, the discharging effect available with the discharger 147 is lower than one available with a DC power source due to the variation of polarity. In light of this, the belt discharging means 123 is used to surely dissipate the charge left on the belt 130.

When the paper sensor S2 or S3, FIG. 11 does not output a signal at an expected timing or continuously outputs a signal even on the elapse of a preselected period of time necessary for the paper 19 to be fed and then discharged, the CPU 171 determines that a paper jam has occurred at the ink drum 3A side, interrupts the operation of the printer, and displays a paper jam on the display 76A. When the paper sensor S3 or S4, FIG. 11, does not output a signal at an expected timing or continuously outputs a signal even on the elapse of a preselected period of time necessary for the paper 19 to be fed and then discharged, the CPU 171 determines that a paper jam has occurred at the ink drum 3B side, interrupts the operation of the printer, and displays a paper jam on the display 76A.

When a paper jam occurs at the ink drum 3A side, the operator watching the above jam display presses the reverse key 80*b*. In response, the belt 130 is caused to rotate clockwise, conveying the jamming paper 19 toward the paper feed device 8. If the paper 19 has jammed the path around the ink drum 3B side, then the operator presses the forward key 80*a*. In response, the belt 130 is caused to rotate counterclockwise, conveying the paper 19 toward the paper discharge device 16.

As stated above, by operating either the forward key 80*a* or the reverse key 80*b*, it is possible to switch the to direction of rotation of the belt 130. Therefore, even when the paper 19 jams the transport path, the operator can remove the paper 19 rapidly. This not only promotes easy operation of the printer, but also reduces the down time and therefore the printing time of the printer. After the removal of the jamming paper 19, the operator presses the reset key 97. In response, the various sections of the printer are restored to their original states and caused to wait for the operation of the print start key 72 for starting printing all over again.

When the operator presses the print mode switch key 174, FIG. 16, the automatic mode is replaced with the manual mode. Then, the clutches 165 and 166, solenoids 141 and 142 and various drivers are once reset so as to give priority to inputs from the drum select keys 168.

Figure 17:
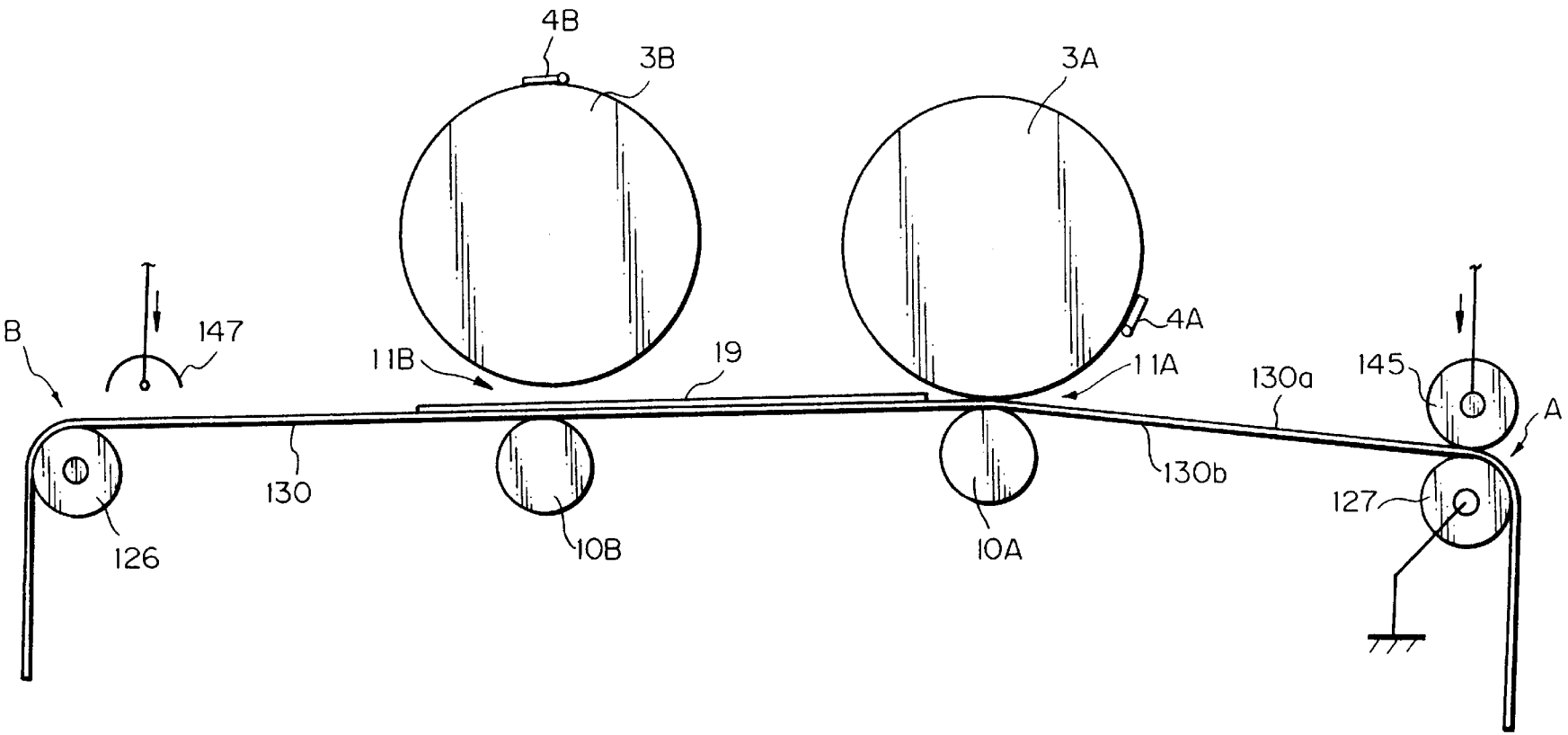
FIG. 17 shows a print section included in the third embodiment in a condition wherein one of two drums is selected.

When the first drum select key 168*a* is pressed, a drive signal is sent to the clutch 165, FIG. 14, so that the rotation of the drum drive motor 152 is transferred only to the ink drum 3A. At the same time, the solenoid 141 is suitably driven in synchronism with the rotation of the ink drum 3A while only the press roller 10A is raised to a position shown in FIG. 17. The other press roller 10B is held in its position spaced from the ink drum 3B, and the drum 3B does not rotate. At this instant, a clamper 4B mounted on the ink drum 3B is held in a position where it does not face the press roller 10B (top of the drum 3B in FIG. 17). The paper 19 is conveyed to the print section 11A by the belt 130 while being electrostatically adhered to the belt 130 due to the charge deposited on the belt 130 by the charge roller 145. At the print section 11A, the ink of first color is transferred from the ink drum 3A to the paper 19, forming an image on the paper 19. The paper 19 with the image is conveyed by the belt 130 toward the print section 11B and is passed through the print section 11B without contacting the ink drum 3B because the press roller 10B is not raised. Subsequently, the paper 19 is discharged by the discharger 147.

Figure 18:
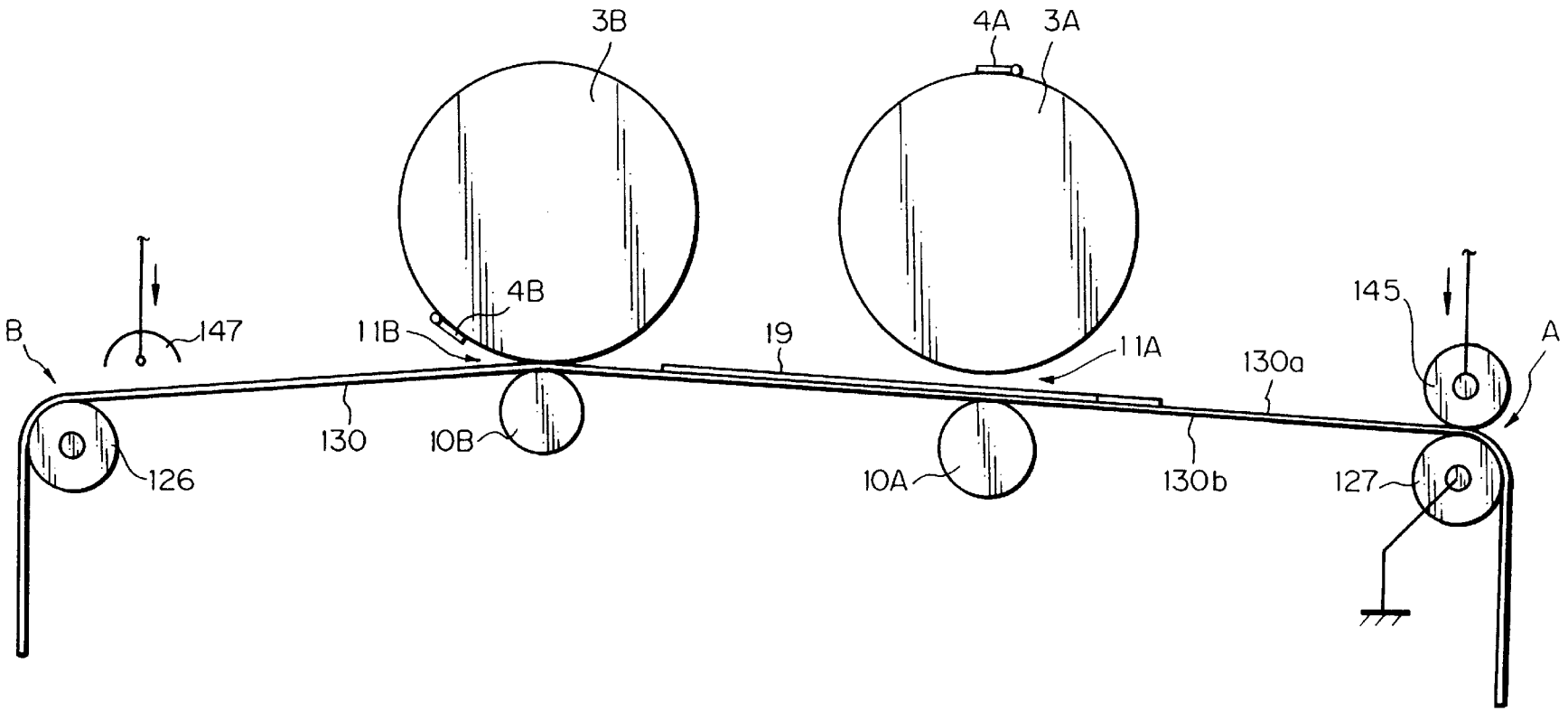
FIG. 18 shows the print section of the third embodiment in a condition wherein the other drum is selected.

When the second drum select key 168*b* is pressed, a drive signal is sent to the clutch 166, FIG. 14, so that the rotation of the drum drive motor 152 is transferred only to the ink drum 3B. At the same time, the solenoid 142 is suitably driven in synchronism with the rotation of the ink drum 3B while only the press roller 10B is raised to a position shown in FIG. 18. The other press roller 10A is held in its position spaced from the ink drum 3A, and the drum 3A does not rotate. At this instant, a clamper 4A mounted on the ink drum 3A is held in a position where it does not face the press roller 10A (top of the drum 3A in FIG. 18). The paper 19 is conveyed to the print section 11B via the print section 11A by the belt 130 while being electrostatically adhered to the belt 130 due to the charge deposited on the belt 130 by the charge roller 145. At the print section 11B, the ink of second color is transferred from the ink drum 3B to the paper 19, forming an image on the paper 19. The paper 19 with the image is discharged by the discharger 147.

As stated above, this embodiment allows the operator to select either one of the ink drums 3A and 3B by operating one of the drum select keys 168 and thereby makes it needless for the operator to remove the ink drum not to be used. This promotes easy and efficient use of the printer. In addition, because the ink drum not to be used does not rotate, the ink fed to the ink drum can maintain its viscosity desirable for printing an image.

In the above embodiment, when either one of the drum select keys 168 is pressed, the ink drum 3A or 3B not selected and the associated press roller 10A or 10B are rendered inoperative. Alternatively, only the solenoid assigned to the ink drum not selected may be deenergized in order to render only the press roller associated with such an ink drum inoperative.

In the first to third embodiments, the electrodes facing the charger 65, charge rollers 109 and 145 and discharge rollers 111 and 149 are, of course, omissible. While the discharger 67 or 147 is shown as adjoining the outer periphery 14*a* of the belt 14 or the outer periphery 130*a* of the belt 130, an electrode may be located in the vicinity of the inner periphery of the belt 14 or that of the belt 130 in such a manner as to face the discharger 67 or 147. Further, another discharger may face the discharger 67 or 147 in order to discharge the belt 14 or 130 at both sides of the belt 14 or 130. In the embodiments shown and described, the belts 14 and 130 each is implemented by a seamless belt and therefore frees printings from marks ascribable to a seam.

In the second and third embodiments, the belt discharging means 107 and 123 are implemented by the charge rollers or contact type charge members 111 and 149, respectively. If desired, the charge rollers 111 and 149 each may be replaced with a non-contact type corona discharge member or a brush or similar friction type discharge member. While the third embodiment has concentrated on a double drum type or bicolor stencil printer, four ink drums may, of course, be arranged in the direction of paper conveyance a in order to construct a full-color stencil printer.

In summary, it will be seen that the present invention provides a stencil printer having various unprecedented advantages, as enumerated below.

(1) A paper fed from a paper feed section is sufficiently electrostatically adhered to a belt before it reaches a print section. This eliminates the need for air suction, an air knife, a separator or the like. The paper can therefore be smoothly conveyed to the print section without any noise and can be surely separated from an ink drum. Because a press roller movable toward and away from the ink drum brings the belt into and out of contact with the drum, an exclusive mechanism for so moving the belt is not necessary. Such a mechanism would complicate the construction and would increase the overall size of the printer.

(2) The area over which the paper is electrostatically adhered to the belt sequentially increases as the paper advances. The paper can therefore be smoothly separated from an upstream ink drum and prevented from rolling up. This obviates the delay of the paper relative to a downstream ink drum and thereby realizes multicolor printing with a minimum of image overlapping and a minimum of image dislocation.

(3) Even when a plurality of ink drums and a plurality of press drums are present, printing can be executed with desired one of the ink drums and associated press roller. The printer is therefore efficiently manipulable.

(4) Charging means for charging the belt and discharging means for cancelling electrostatic adhesion acting between the belt and the paper after printing are provided. These means insure stable charging of the belt despite aging and allow the paper with an image to be smoothly separated from the belt.

(5) The paper electrostatically adhered to the belt can be selectively conveyed toward the paper feed section or a paper discharge section, as needed. The paper can therefore be rapidly removed when jamming a transport path, so that the printing time is reduced.

(6) The paper fed from the paper feed section is nipped between the belt and a paper pressing member at a position between the paper feed section and the print section. The belt and paper can therefore closely contact each other. This further promotes the smooth conveyance of the paper to the print section and allows the leading edge of the paper to enter the print section stably. In addition, the paper is smoothly separated from the ink drum without rolling up.

(7) The charging means directly injects a charge for causing the paper to electrostatically adhere to the belt and therefore efficiently charges the belt. This intensifies the electrostatic adhesion between the paper and the belt, further promotes the smooth conveyance of the paper to the print section, and allows the leading edge of the paper to enter the print section stably. Further, the paper is smoothly separated from the ink drum without rolling up. In addition, the charging means and paper pressing means can be implemented by a single member in order to reduce the number of parts and space requirement. This is successful to further reduce the overall size of the printer.

(8) Because the belt is a seamless belt, the paper is free from a mark ascribable to a seam and otherwise formed when the paper is nipped between the ink drum and the belt at the print section.

(9) When an electrode is positioned to face the charging means, the charge can be desirably injected into the belt. The electrode therefore stabilizes the charge of the belt and thereby insures the electrostatic adhesion of the paper to the belt. This promotes the smooth conveyance of the paper to the print section, and allows the leading edge of the paper to enter the print section stably. Further, the paper is smoothly separated from the ink drum without rolling up.

(10) After the separation of the paper, the belt is surely discharged and suffers from a minimum of irregular charge.

The charging means can therefore desirably charge the belt later. This further improves and stabilizes the conveyance of the paper, entry of the paper into the print section, and the separation of the paper from the ink drum.

(11) The belt and pressing means are constantly pressed against each other. Therefore, despite the movement of the pressing means toward and away from the ink drum, the peripheral speed of the belt or that of the pressing means does not noticeably change. This stabilizes the conveying speed of the belt and thereby further improves and stabilizes the conveyance of the paper, entry of the paper into the print section, and the separation of the paper from the ink drum.

Various modifications will become possible for those skilled in the art after receiving the teachings of the present disclosure without departing from the scope thereof.

What is claimed is:

1. A stencil printer comprising:

at least one ink drum for wrapping a master around an outer periphery thereof;

an ink feeding device configured to feed ink to the master wrapped around said ink drum;

a belt conveyor including a belt extending between a paper feed section located upstream of a print section in a direction of paper conveyance and a paper discharge section located downstream of said print section in said direction through said print section, said belt conveying a paper fed from said paper feed section while causing said paper to electrostatically adhere to said belt;

a paper pressing member disposed between said paper feed section and said print section and being in contact with a portion of said belt; and a pressing device configured to move said belt into and out of contact with said ink drum at a position where said pressing device faces said ink feeding device, wherein an image is printed on the paper fed from said paper feed section at said print section where said ink drum and said pressing device face each other.

2. A stencil printer as claimed in claim 1, wherein a plurality of ink drums are arranged side by side in the direction of paper conveyance.

3. A stencil printer as claimed in claim 2, further comprising:

a drum selecting device arranged on an operation panel and configured to allow an operator to select a desired one of said plurality of ink drums; and a control device configured to render the ink drum selected on said drum selecting device and said pressing device associated with said ink drum operable for printing.

4. A stencil printer as claimed in claim 3, further comprising:

a charging device configured to charge said belt; and a discharging device configured to cancel electrostatic adhesion acting between said belt and the paper carrying an image thereon.

5. A stencil printer as claimed in claim 4, wherein said belt of said belt conveyor is selectively movable in either one of opposite directions.

6. A stencil printer as claimed in claim 5, wherein said paper pressing member comprises a discharge member included in said charging device.

7. A stencil printer as claimed in claim 6, wherein said belt comprises a seamless belt.

8. A stencil printer as claimed in claim 7, wherein said belt conveyor further comprises a roller member over which said belt is passed, said roller member constituting a facing electrode included in said charging device.

9. A stencil printer as claimed in claim 8, further comprising a belt discharging device configured to discharge said belt afer separation of the paper from said belt.

10. A stencil printer as claimed in claim 9, wherein said pressing device is in constant contact with said belt.

11. A stencil printer as claimed in claim 1, further comprising:

a charging device configured to charge said belt; and a discharging device configured to cancel electrostatic adhesion acting between said belt and the paper carrying an image thereon.

12. A stencil printer as claimed in claim 11, wherein said belt of said belt conveyor is selectively movable in either one of opposite directions.

13. A stencil printer as claimed in claim 12, wherein said paper pressing member comprises a discharge member included in said charging device.

14. A stencil printer as claimed in claim 13, wherein said belt comprises a seamless belt.

15. A stencil printer as claimed in claim 14, wherein said belt conveyor further comprises a roller member over which said belt is passed, said roller member constituting a facing electrode included in said charging device.

16. A stencil printer as claimed in claim 15, further comprising a belt discharging device configured to discharge said belt after separation of the paper from said belt.

17. A stencil printer as claimed in claim 16, wherein said pressing device is in constant contact with said belt.

18. A stencil printer as claimed in claim 11, wherein said paper pressing member comprises a discharge member included in said charging device.

19. A stencil printer as claimed in claim 12, wherein said belt comprises a seamless belt.

20. A stencil printer as claimed in claim 11, wherein said belt conveyor further comprises a roller member over which said belt is passed, said roller member constituting a facing electrode included in said charging device.

21. A stencil printer as claimed in claim 1, wherein said pressing device is in constant contact with said belt.

22. A stencil printer as claimed in claim 1, further comprising a belt discharging device configured to discharge said belt after separation of the paper from said belt.

23. A stencil printer as claimed in claim 22, wherein said pressing device is in constant contact with said belt.

* * * * *